US009852583B2

(12) United States Patent
Hall

(10) Patent No.: US 9,852,583 B2
(45) Date of Patent: Dec. 26, 2017

(54) METHODS OF ADMINISTERING LAMMER-BASED WAGERS

(71) Applicant: Customized Games Limited, Shirley (GB)

(72) Inventor: Geoff Hall, Shirley (GB)

(73) Assignee: Customized Games Limited, Shirley (GB)

( * ) Notice: Subject to any disclaimer, the term of this patent is extended or adjusted under 35 U.S.C. 154(b) by 324 days.

(21) Appl. No.: 14/498,232

(22) Filed: Sep. 26, 2014

(65) Prior Publication Data

US 2016/0093168 A1 Mar. 31, 2016

(51) Int. Cl.

| | |
|---|---|
| ***A63F 9/00*** | (2006.01) |
| ***G07F 17/32*** | (2006.01) |
| ***A63F 1/00*** | (2006.01) |
| ***A63F 3/00*** | (2006.01) |

(52) U.S. Cl.

CPC ..... *G07F 17/3262* (2013.01); *A63F 1/00* (2013.01); *A63F 3/00157* (2013.01); *G07F 17/3244* (2013.01); *A63F 2001/005* (2013.01); *A63F 2003/00164* (2013.01); *G07F 17/3293* (2013.01)

(58) Field of Classification Search

None

See application file for complete search history.

(56) References Cited

U.S. PATENT DOCUMENTS

| | | | | |
|---|---|---|---|---|
| 6,179,710 | B1 * | 1/2001 | Sawyer | A63F 3/00157 273/138.2 |
| 6,267,248 | B1 | 7/2001 | Johnson et al. | |
| 6,588,750 | B1 | 7/2003 | Grauzer et al. | |
| 6,659,460 | B2 | 12/2003 | Blaha et al. | |
| 6,698,756 | B1 | 3/2004 | Baker et al. | |
| 6,755,741 | B1 | 6/2004 | Rafaeli | |
| 7,661,676 | B2 | 2/2010 | Smith et al. | |
| 7,677,565 | B2 | 3/2010 | Grauzer et al. | |
| 7,766,332 | B2 | 8/2010 | Grauzer et al. | |
| 7,901,285 | B2 | 3/2011 | Tran et al. | |
| 7,934,980 | B2 | 5/2011 | Blaha et al. | |
| 7,954,821 | B2 | 6/2011 | Reabe, Jr. | |
| RE42,944 | E | 11/2011 | Blaha et al. | |
| 8,070,574 | B2 | 12/2011 | Grauzer et al. | |
| 8,262,475 | B2 | 9/2012 | Snow et al. | |
| 8,272,958 | B2 | 9/2012 | Smith et al. | |
| 8,511,684 | B2 | 8/2013 | Grauzer et al. | |
| 8,579,289 | B2 | 11/2013 | Rynda et al. | |

(Continued)

*Primary Examiner* — Seng H Lim

(74) *Attorney, Agent, or Firm* — TraskBritt

(57) ABSTRACT

Methods of administering wagering games may involve accepting a base game wager from a player to participate in a base game. The base game may involve presenting one or more lammers in response to an occurrence of one or more chance events, acceptance of one or more player instructions affecting game play of the base game, or the occurrence of the one or more chance events and the acceptance of the one or more player instructions affecting the game play of the base game in response to the occurrence of the one or more chance events. A side wager may be accepted from the player before any qualifying lammers can be presented. The side wager may be resolved by determining whether any qualifying lammers have been presented. A payout on the side wager may be paid to the player in response to a presence of at least one qualifying lammer.

20 Claims, 13 Drawing Sheets

(56) References Cited

U.S. PATENT DOCUMENTS

| | | | | |
|---|---|---|---|---|
| 2001/0028147 | A1* | 10/2001 | Ornstein | A63F 3/00157 273/292 |
| 2005/0164759 | A1 | 7/2005 | Smith et al. | |
| 2007/0290441 | A1* | 12/2007 | Ornstein | A63F 3/00157 273/292 |
| 2009/0170595 | A1 | 7/2009 | Walker | |
| 2010/0004051 | A1* | 1/2010 | Walker | G07F 17/32 463/22 |
| 2010/0038849 | A1 | 2/2010 | Scheper et al. | |
| 2012/0252564 | A1 | 10/2012 | Moore et al. | |
| 2013/0150138 | A1 | 6/2013 | Hall | |
| 2013/0184059 | A1 | 7/2013 | Costello et al. | |
| 2013/0184079 | A1 | 7/2013 | Costello et al. | |
| 2013/0234389 | A1* | 9/2013 | McCreedy | A63F 1/00 273/274 |
| 2013/0296025 | A1 | 11/2013 | Castle, II et al. | |
| 2013/0324217 | A1 | 12/2013 | Gilbertson et al. | |
| 2014/0027979 | A1 | 1/2014 | Stasson et al. | |
| 2014/0370980 | A1 | 12/2014 | Czyzewski et al. | |

* cited by examiner

METHODS OF ADMINISTERING LAMMER-BASED WAGERS

FIELD

This disclosure relates generally to methods of administering wagering games for casinos and other gaming establishments, and related systems and apparatuses. More specifically, disclosed embodiments relate to methods of administering wagering games involving accepting a lammer-based wager and paying a payout based on whether a lammer is present.

BACKGROUND

When administering a wagering game, lammers (e.g., buttons or markers) may be used to track certain game-related events. For example, lammers may be used to track which player is required to place a blind wager (e.g., a big blind or a small blind) in a game where the obligation to make a blind wager at the beginning of a round moves from player to player, such as, for example, Texas Hold'Em. As another example, lammers may be used to indicate whether lay and buy wagers in craps are on or off.

As yet another example, U.S. Patent App. Pub. No. 2001/0028147, published Oct. 11, 2001, to Ornstein et al., discloses a side wager that involves a player predicting a number of consecutive wins, losses, or ties in an underlying game. Lammers may be used to track the number of correctly predicted consecutive wins, losses, or ties.

BRIEF SUMMARY

In some embodiments, methods of administering wagering games may involve accepting a base game wager from a player to participate in a base game. The base game may involve presenting one or more lammers in response to an occurrence of one or more chance events, acceptance of one or more player instructions affecting game play of the base game, or the occurrence of the one or more chance events and the acceptance of the one or more player instructions affecting the game play of the base game in response to the occurrence of the one or more chance events. An optional side wager may be accepted from the player before any qualifying lammers can be presented. The side wager may be resolved by determining whether any qualifying lammers have been presented. A payout on the side wager may be paid to the player in response to a presence of at least one qualifying lammer.

In other embodiments, methods of administering wagering games may involve accepting a base game wager from a player to participate in a base game. The base game may involve presenting one or more lammers in response to acceptance of one or more player instructions affecting game play of the base game or an occurrence of one or more chance events and the acceptance of the one or more player instructions affecting the game play of the base game in response to the occurrence of the one or more chance events. A mandatory side wager may be accepted from the player before any qualifying lammers can be presented. The side wager may be resolved by determining whether any qualifying lammers have been presented. A payout on the side wager may be paid to the player in response to a presence of at least one qualifying lammer.

In still other embodiments, methods of administering wagering games over networks utilizing servers including processors may involve: receiving at a server comprising a processor an electronic signal indicating that allocation of funds to a base game wager was authorized by a player to participate in a base game. The base game may involve sending from the server an electronic signal instructing that one or more electronic images of lammers are to be displayed on a client device in response to an occurrence of one or more chance events, acceptance of one or more player instructions affecting game play of the base game, or the occurrence of the one or more chance events and the acceptance of the one or more player instructions affecting the game play of the base game in response to the occurrence of the one or more chance events. The server may receive an electronic signal indicating that allocation of funds to a side wager was authorized by the player before any electronic images of qualifying lammers can be displayed. The side wager may be resolved by determining at the server whether any electronic signals instructing that any electronic images of qualifying lammers were to be displayed have been sent. The server may generate an electronic signal indicating that payment of a payout on the side wager to the player is authorized in response to the sending of at least one electronic signal instructing that one or more electronic images of qualifying lammers were to be displayed.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

Figure 1:
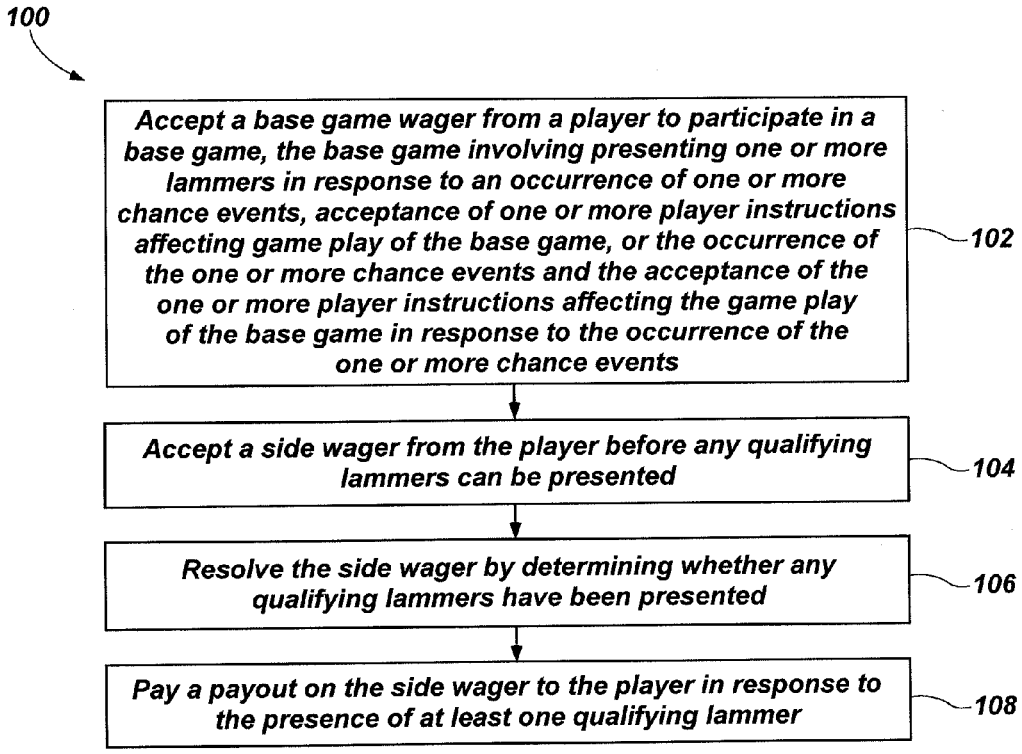
FIG. 1 is a flowchart diagram of a method of administering a wagering game, according to an embodiment of this disclosure.

The illustrations presented in this disclosure are not meant to be actual views of any particular act in a method, apparatus, system, or component thereof, but are merely idealized representations employed to describe illustrative embodiments. Thus, the drawings are not necessarily to scale. Additionally, elements common between figures may retain the same or similar numerical designation. Elements with the same number, but including a different alphabet character as a suffix should be considered as multiple instantiations of substantially similar elements and may be referred generically without an alphabet character suffix.

The terms "gaming," "gambling," or the like, refer to activities, games, sessions, rounds, hands, rolls, operations, and other events related to wagering games the outcome of which is at least partially based on one or more random events ("chance" or "chances"), and on which wagers may be placed by a player. In addition, the words "wager," "bet," "bid," or the like, refer to any type of wager, bet, or gaming venture that is placed on random events, whether of monetary or non-monetary value. Points, credits, and other items of value may be purchased, earned, or otherwise issued prior to beginning the wagering game. In some embodiments, purchased points, credits, or other items of value may have an exchange rate that is not one-to-one to the currency used by the user. For example, a wager may include money, points, credits, symbols, or other items that may have some value related to a wagering game. Wagers may be placed in wagering games that involve the risk of real-world monetary value for the potential of payouts with real-world monetary value (e.g., the "play-for-pay," such as "house-banked," "player-banked," "player-pooled" including "player-pooled progressive," and "dividend refund" configurations, each of which is described in more detail below) or in wagering games that involve no real-world monetary risks for the player (e.g., the "play-for-fun" and "social play-for-fun" configurations described in more detail below).

As used herein, the term "wager" includes any form of wagering value, including money, casino chips, other physical means for payment, and online or remote electronic authorization of a wager in any acceptable form to the casino or online or virtual game host. Also included are physical representations of money (e.g., casino chips) at a local game, as well as virtual representations of money in the form of electronic authorizations of a transfer of money and digital representations of money (e.g., digital representations of bills or coins, digital representations of chips, numerical quantities of money, numerical quantities of points, or numerical quantities of credits) at a local or remote electronic gaming device. As used herein, the term "wagering element" means and includes objects and symbols used to signify the acceptance of a wager. For example, physical wagering elements include physical money (e.g., bills and coins) and physical wagering tokens (e.g., poker chips), which may or may not be redeemable for monetary value and may or may not include electronic identifiers (e.g., RFID chips) embedded within the tokens, enabling electronic sensing and tracking of wagering. Virtual wagering elements include, for example, images (e.g., images of money or poker chips) and text (e.g., a string of numbers), which may or may not be redeemable for monetary value. In the "play-for-fun" and "social play-for-fun" configurations, a "wager" may not have a cash value (i.e., a real-world monetary value).

For the purposes of this description, it will be understood that when an action related to accepting wagers, making payouts, dealing cards, selecting cards, or other actions associated with a player or a dealer is described herein, and such description includes a player or a dealer taking the action, the results of the action may be computer generated and may be displayed on a live or virtual table or electronic display, and, if applicable, the reception or detection of such an action in an electronic form where player and dealer choices, selections, or other actions are received at an electronic interface. This further includes the results of a virtual dealer and virtual players, where the actions described are actually generated by a computer (typically associated with an online game). By way of a further example, if dealing of a card is described herein, the description includes (but is not limited to) the following: the dealing of a card by a dealer from a deck, shuffler, shoe, or other card source and the reception or placement of the card at a table location associated with a player or reception directly by a player; the generation and transmission of an electronic indication or representation of a card from a game play source or server to an electronic receiver, where the receiver may be at a table (using virtual cards) including players and/or virtual players and/or a dealer or virtual dealer, on a gaming terminal, at a public display in a casino, at a remote location (e.g., using online or Internet game play), or at other locations. Also included is the representation of a card on a display or displays, and, if applicable to the action described, an electronic reception of an indication that the card has been received, selected, or otherwise interacted with at a location associated with a player or associated with a virtual player. In addition, dealing of a card may refer to revealing a representation of a card on a scratch-off card (also referred to as "scratchers").

Referring to FIG. 1, a flowchart diagram of a method 100 of administering a wagering game is shown. The method 100 may involve accepting a base game wager from a player to participate in a base game, as indicated at 102. For example, the base game wager may be an ante wager or a blind wager to participate in blackjack, a variant of blackjack, poker, a variant of poker, baccarat, a variant of baccarat, pai gow poker, a variant of pai gow poker, casino war, a variant of casino war, craps, a variant of craps, roulette, a variant of roulette, or some other wagering game. The base game wager may be accepted, for example, by receiving a physical, monetarily valuable wagering element in a player area (e.g., within a designated base game wager space) on a physical layout of a gaming table or by a processor receiving an electronic signal indicating that allocation of funds to the base game wager has been authorized. More specifically, the base game wager may be accepted, for example, by receiving physical wagering elements within a designated area 118 (see FIGS. 2, 3) in a player area 112 (see FIGS. 2, 3) on a playing surface 110 (see FIG. 2) of a gaming table 200, 400, or 500 (see FIGS. 4, 6, 7), by automatically detecting (e.g., using sensors, such as, for example, optical or RFID sensors) the presence of wagering elements within the designated area 118 (see FIGS. 2, 3) on the surface 110 of the gaming table 200, 400, or 500 (see FIGS. 4, 6, 7), or by receiving an electronic signal at a processor 350, 414, 428, 597, or 642 (see FIGS. 5-7, 10) indicating that allocation of funds to the base game wager was authorized (e.g., by using a player interface 332, 416, 532, 624, or 644 (see FIGS. 5-8, 10) or dealer interface 418 (see FIG. 6) to charge a player account).

The base game may involve presenting one or more lammers in response to an occurrence of one or more chance events, acceptance of one or more player instructions affecting game play of the base game, or the occurrence of the one or more chance events and the acceptance of the one or more player instructions affecting the game play of the base game in response to the occurrence of the one or more chance events. More specifically, the base game may involve, for example, presenting an additional lammer in response to each occurrence of the one or more chance events, each acceptance of the one or more player instructions affecting the game play of the base game, or each occurrence of the one or more chance events and each corresponding acceptance of the one or more player instructions affecting the game play of the base game in response to each occurrence of the one or more chance events. As a specific, nonlimiting example, the base game may involve presenting each lammer in a player area in response to each occurrence of the one or more chance events, each acceptance of the one or more player instructions affecting the game play of the base game, or each occurrence of the one or more chance events and each corresponding acceptance of the one or more player instructions affecting the game play of the base game in response to each occurrence of the one or more chance events. The player area may be associated with the player with whom the one or more chance events are connected or from whom the one or more player instructions are accepted.

For example, a lammer may be presented when a hand (e.g., an initial hand or a final hand) of a specific point value (e.g., 3, 4, 5, 15, 19, 20, or 21) is dealt to a player in a game of blackjack or a variant of blackjack, when a face-up card dealt to the dealer is a predetermined card (e.g., ace of spades) or is of a specific point value (e.g., 10) in a game of blackjack or a variant of blackjack, or when a predetermined outcome (e.g., 0, 00, 7, or 13) is generated in a game of roulette or a variant of roulette. As other examples, a lammer may be presented when a player election to double (i.e., to double the amount wagered in connection with the base game wager and receive one, and only one, hit card) is accepted in a game of blackjack or a variant of blackjack, when a player election to check (i.e., not to increase an amount of a wager) is accepted in a game of poker or a variant of poker, or when a player election to stand (i.e., not to receive any more cards) is accepted in a game of blackjack or a variant of blackjack. As yet another example, a lammer may be presented when two cards of equal point value have been dealt to a player and the player's election to split (i.e., to separate the cards into their own separate hands, add an additional wager corresponding to the additional hand, and receive cards to complete the hands) is accepted in a game of blackjack or a variant of blackjack.

As specific, nonlimiting examples, a lammer may be presented when a player election to double (i.e., to double the amount wagered in connection with the base game wager and receive one, and only one, hit card) is accepted in a game of blackjack or a variant of blackjack or when two cards of equal point value have been dealt to a player and the player's election to split (i.e., to separate the cards into their own separate hands, add an additional wager corresponding to the additional hand, and receive cards to complete the hands) is accepted in the game of blackjack or the variant of blackjack. In some embodiments, the player's election to double or split may be accepted without requiring the player to risk additional monetary value in connection with the election to double or split. In such embodiments, the lammer may take the place of the additional wagering elements that the player would otherwise have been required to risk when doubling or splitting.

One or more lammers may be presented by, for example, placing a physical lammer on a physical layout (e.g., in a player area or a community area, optionally within a designated lammer space) of a gaming table or by a processor sending an electronic signal indicating that an electronic image of a lammer is to be displayed (e.g., by a display device). More specifically, one or more lammers may be presented by, for example, placing a physical lammer within a player area 112 (see FIGS. 2, 3) on a playing surface 110 (see FIG. 2) of a gaming table 200, 400, or 500 (see FIGS. 4, 6, 7) or by sending an electronic signal from a processor 350, 414, 428, 597, or 642 (see FIGS. 5-7, 10) indicating that an electronic image of a lammer is to be displayed by a display device.

A side wager may be accepted from the player before any qualifying lammers can be presented during game play, as indicated at 104. In some embodiments, the side wager may be optional. In other embodiments, the side wager may be mandatory. The side wager may be a lammer-based wager, the outcome of which may depend on whether one or more qualifying lammers (i.e., any lammer that affects the outcome of the side wager) has been presented during play of the base game. More specifically, the outcome of the side wager may depend, for example, on whether one or more qualifying lammers has been presented during a single round of play of the base game. The side wager may be accepted by, for example, performing any of the acts described previously in connection with accepting the base game wager.

A round of the base game may be played according to base game rules. During the course of the round of play, the base game rules may dictate that a lammer be presented when one or more chance events occurs, one or more player instructions affecting game play of the base game is accepted, or the one or more chance events occurs and the one or more player instructions affecting the game play of the base game is accepted in response to the occurrence of the one or more chance events.

The side wager may be resolved by determining whether any qualifying lammers have been presented, as indicated at 106. More specifically, the side wager may be resolved by determining whether any qualifying lammers were presented, for example, during a single round of play of the underlying base game. The side wager may be resolved by, for example, visually inspecting qualifying areas of a playing surface 110 (see FIG. 2) of a gaming table 200, 400, or 500 (see FIGS. 4, 6, 7), electronically inspecting and evaluating the qualifying areas of a playing surface 110 (see FIG. 2) of a gaming table 200, 400, or 500 (see FIGS. 4, 6, 7) (e.g., using sensors, such as, for example, optical or RFID sensors and a processor 350, 414, 428, 597, or 642 (see FIGS. 5-7, 10)), or electronically evaluating computer-simulated qualifying areas at a processor 350, 414, 428, 597, or 642 (see FIGS. 5-7, 10) to determine whether any physical or electronically displayed lammers have been presented.

In some embodiments, only some of the lammers presented during the course of a round of play may qualify to render the side wager a win for the player. For example, only those lammers presented in response to table-wide chance events (e.g., community chance events), table-wide player elections (e.g., community player elections), player-specific chance events occurring to the player who made the side wager, and player-specific player elections accepted from the player who made the side wager may qualify to render the side wager a win for that player. More specifically, only those lammers presented in response to player-specific chance events occurring to the player who made the side wager, and player-specific player elections accepted from the player who made the side wager may qualify to render the side wager a win for that player. As a specific, nonlimiting example, only those lammers presented within the player area of the player who made the side wager may qualify to render the side wager a win for that player. In other embodiments, any lammer presented during a round of play may qualify each side wager as a win, regardless of who made the side wager, in connection with whom the relevant random event occurred, and from whom the relevant player instruction was accepted.

In some embodiments, resolution of the side wager may further involve evaluating a qualifying condition or a disqualifying condition that may occur in the base game. For example, players may be required to achieve a hand of a predetermined rank or higher in a game of poker or a variant of poker, to achieve a hand of a predetermined point total or higher in a game of blackjack or a variant of blackjack, or to win their base game wager in a game of roulette or a variant of roulette to qualify to win the side wager. As another example, a dealer hand of a predetermined rank or lower in a game of poker or a variant of poker, a dealer hand of a predetermined score or higher in a game of blackjack or a variant of blackjack, or a predetermined chance outcome in a game of roulette or a variant of roulette (e.g., a 0 or 00) or in a game of craps or a variant of craps (e.g., a 7 on the "come out roll") may disqualify the side wager from being a win, regardless of whether any qualifying lammers have been presented. As a specific, nonlimiting example, the side wager may be disqualified from winning, regardless of whether any qualifying lammers have been presented, when the dealer hand is a blackjack (i.e., a hand consisting of a 10-point-value card and an ace). In other embodiments, there may not be any qualifying or disqualifying conditions that may occur in the base game, other than those events or player elections that may result in the presentation of one or more qualifying lammers.

A payout on the side wager may be paid to the player in response to a presence of at least one qualifying lammer, as indicated at 108. In some embodiments, a fixed payout may be paid regardless of the total number of qualifying lammers presented, so long as at least one qualifying lammer has been presented. In other embodiments, an amount of the payout may increase as a number of qualifying lammers increases. For example, the fixed payout multipliers used to calculate a fixed odds payout may increase as the number of qualifying lammers increases. As a specific, nonlimiting example, the payout may be paid according to either of the two following pay tables:

| No. of Qualifying Lammers Presented | Pay Table 1 | Pay Table 2 |
|---|---|---|
| 1 | 3:1 | 3:1 |
| 2 | 10:1 | 12:1 |
| 3 | 30:1 | 30:1 |
| 4 | 60:1 | 50:1 |
| 5 | 100:1 | 100:1 |
| 6 | 300:1 | 100:1 |
| 7 | 1,000:1 | 100:1 |

Paying the payout may involve, for example, transferring physical wagering elements, crediting a win meter, or generating an electronic signal indicating that transfer of funds to a player account is authorized. More specifically, the payout may be paid by, for example, giving physical wagering elements to a player on a playing surface 110 (see FIG. 2) of a gaming table 200, 400, or 500 (see FIGS. 4, 6, 7), generating at a processor 350, 414, 428, 597, or 642 (see FIGS. 5-7, 10) in response to dealer input from a dealer interface 418 (see FIG. 6), an electronic signal indicating that transfer of funds from a house account server 632 (see FIG. 8) to a player account is authorized, or automatically generating the electronic signal at the processor 350, 414, 428, 597, or 642 (see FIGS. 5-7, 10) indicating that transfer of funds from an account server 632 (see FIG. 8) to a player account is authorized. As a specific, nonlimiting example, the payout may be paid by physically transferring wagering elements from a rack 208 or 420 (see FIGS. 4, 6) to the player.

When no qualifying lammers have been presented, an amount of the side wager may be, for example, collected for the house. The amount of the side wager may be collected for the house by, for example, retrieving each physical wagering element associated with the side wager of the player from the playing surface 110 (see FIG. 2) of the gaming table 200, 400, or 500 (see FIGS. 4, 6, 7) and transferring them to a rack 208 or 420 (see FIGS. 4, 6) of house wagering elements or generating an electronic signal (e.g., automatically or in response to a player or dealer input) at a processor 350, 414, 428, 597, or 642 (see FIGS. 5-7, 10) indicating that transfer of an amount of the ante wager to a house account 632 (see FIG. 8) is authorized.

The base game wager may be resolved, and any payouts may be paid, wagered amounts may be returned (e.g., in response to a push condition), or wagered amounts may be collected, according to rules of the base game.

U.S. patent application Ser. No. 13/659,912 is incorporated by reference herein in its entirety and describes a blackjack variation. In Ser. No. 13/659,912, "NCV chip" as used therein is a qualifying lammer. Each time the player makes a double or a split the player is provided with a free NCV chip (lammer) which is placed on the player's betting area. In an embodiment, doubles and splits can be provided to the player for free and the player receives a free NCV chip upon each opportunity to receive a free double and/or free split. Thus, at the end of the hand, for example, if the player has 2 NCV chips (e.g., the player split and then doubled on one of the splits), the player would win a 10:1 payout on his/her side wager (from Table I) assuming the player made the side wager. In FIG. 9D of Ser. No. 13/659,912, the player has only one lammer and thus the player would win a 3:1 payout on his/her side wager (assuming the player made the side wager).

Note that if the player made the side wager and the player splits and then busts the hand, the qualifying lammer (NCV chip) will remain so that the dealer can monitor how many qualifying lammers the player has earned. The outcome of the game does not matter (e.g., busting, winning, losing, etc.), what only matters is how many qualifying lammers the player received on a particular game which determines the payout. All NCV chips awarded to the player as described in Ser. No. 13/659,912 are qualifying lammers used to determine the payout of the side wager.

Various platforms are contemplated that are suitable for implementation of embodiments of wagering games according to this disclosure. For example, embodiments of wagering games may be implemented as live table games with an in-person dealer, electronic gaming machines, partially or fully automated table games, and partially or fully automated, network-administered games (e.g., Internet games) wherein game results may be produced utilizing a processor or a live video feed of a dealer administering a game from a remote studio.

As previously noted, any of the present methods and games may be played as a live casino table card game, as a hybrid casino table card game (with virtual cards or virtual chips), on a multi-player electronic platform (as disclosed in U.S. patent application Ser. No. 10/764,827, filed Jan. 26, 2004, published as U.S. Patent Application Publication No. 2005/0164759 on Jul. 28, 2005, now abandoned; U.S. patent application Ser. No. 10/764,994, filed Jan. 26, 2004, now U.S. Pat. No. 7,661,676, issued Feb. 16, 2010; and U.S. patent application Ser. No. 10/764,995, filed Jan. 26, 2004, now U.S. Pat. No. 8,272,958, issued Sep. 25, 2012; the disclosure of each of which applications and patents is incorporated herein in its entirety by this reference), on a personal computer for practice, on a hand-held game for practice, on a legally-authorized site on the Internet, or on a play-for-fun site on the Internet.

For example, in one embodiment, the players may be remotely located from a live dealer, and a live dealer and a game table may be displayed to players on their monitors via a video feed. The players' video feeds may be transmitted to the dealer and may also be shared among the players at the table. In a sample embodiment, a central station may include a plurality of betting-type game devices and an electronic camera for each game device. A plurality of player stations, remotely located with respect to the central station, may each include a monitor, for displaying a selected game device at the central station, and input means, for selecting a game device and for placing a bet by a player at the player's station relating to an action involving an element of chance to occur at the selected game device. Further details on gambling systems and methods for remotely-located players are disclosed in U.S. Pat. No. 6,755,741 B1, issued Jun. 29, 2004, titled "GAMBLING GAME SYSTEM AND METHOD FOR REMOTELY-LOCATED PLAYERS," the disclosure of which is incorporated herein in its entirety by this reference.

Figure 2:
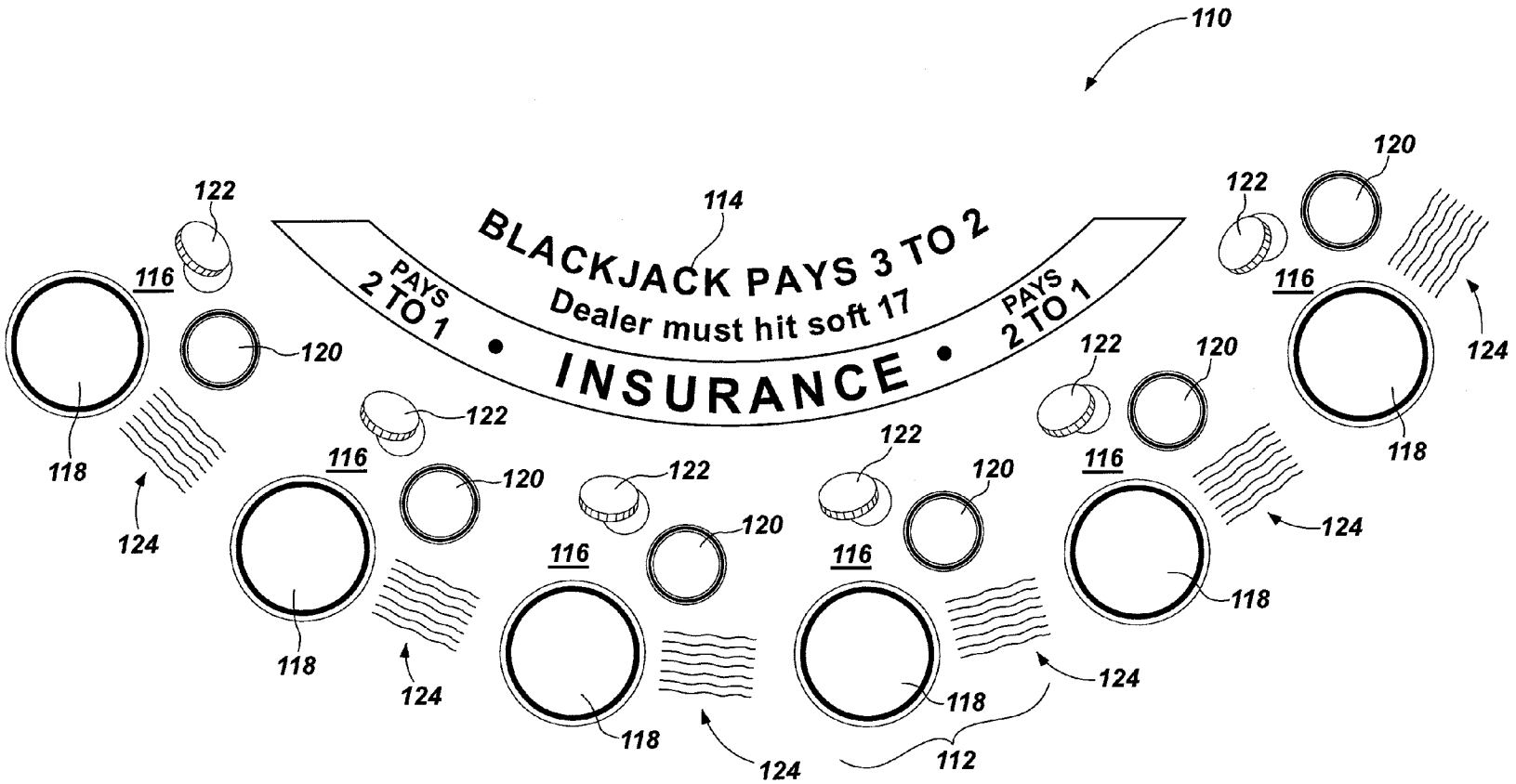
FIG. 2 is a diagram of a playing surface for implementation of a method of administering a wagering game, according to an embodiment of this disclosure.

FIG. 2 is a diagram of a playing surface 110 for implementing wagering games within the scope of this disclosure. Such an implementation may be, for example, a felt layout on a physical gaming table or an electronic representation on an electronic display. As shown in FIG. 2, the base game may be blackjack or a variant of blackjack, with a layout corresponding to the particular wagers, dealing, and other actions associated with the play and administration of blackjack or the variant of blackjack. In other embodiments, modifications may be made to the layout of the playing surface 110 to better suit the base game being played, such as any of the base games described previously in connection with FIG. 1. The playing surface 110 may include multiple player positions 112 within which wagering and game events associated with individual players may occur. The playing surface 110 may also include a dealer area 114 within which game events and administrative events associated with the dealer may occur.

Figure 3:
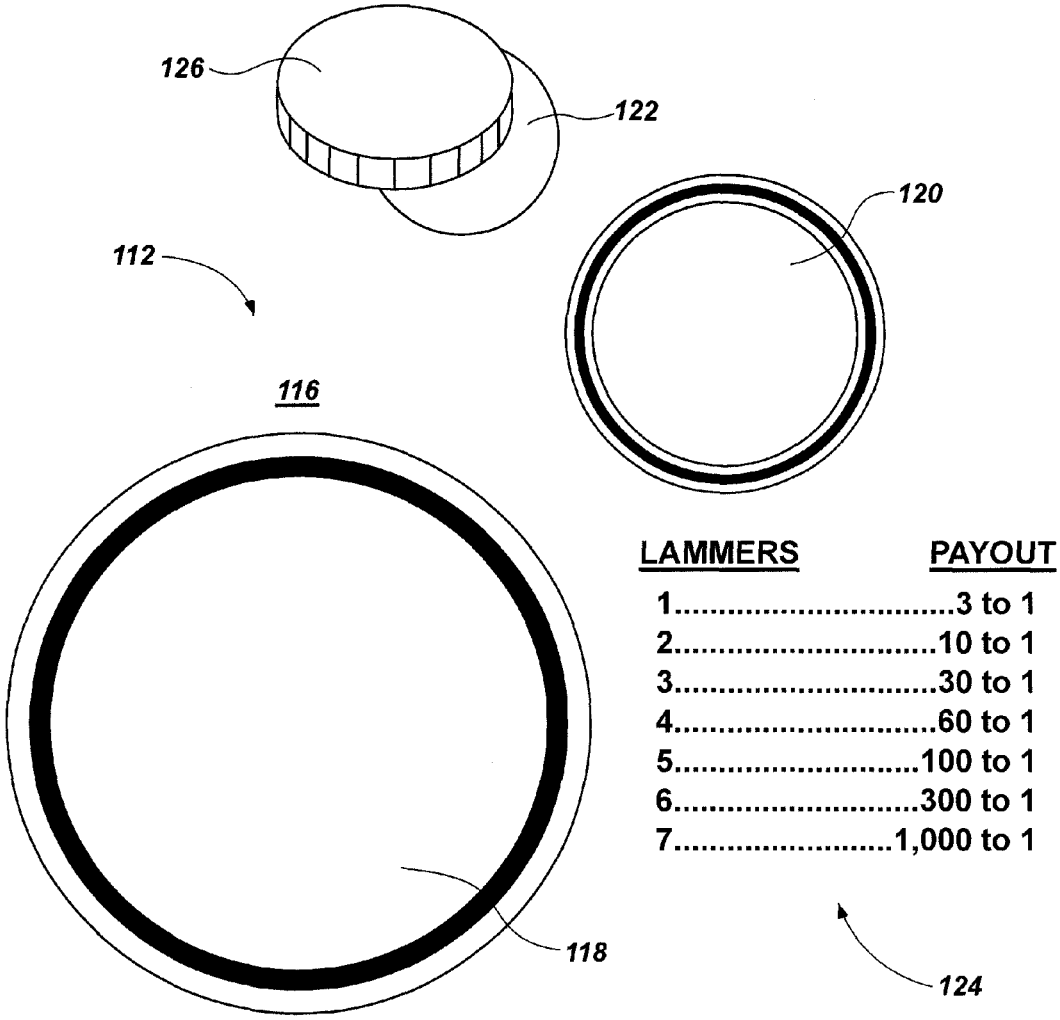
FIG. 3 is an enlarged diagram of a player position of the playing surface of FIG. 2.

FIG. 3 is an enlarged diagram of one of the player positions 112 on the playing surface 110 of FIG. 2. Each player position 112 may include an area 116 within which cards may be dealt to the player. Each player position 112 may further include a first designated area 118 for accepting the base game wager. Each player position 112 may include a second designated area 120 for accepting a side wager. In some embodiments, each player position 112 may include a third designated area 122 for presenting one or more lammers. Each of the designated areas 118 through 122 may be separate and distinct from one another. In some embodiments, each player position 120 may include pay tables 124 displaying payouts associated with one or more of the wagers.

The results of actions performed when administering wagering games in accordance with this disclosure may be reflected on the playing surface 132. For example, and referring collectively to FIGS. 2 and 3, a base game wager (e.g., an ante wager) on a game of blackjack or a variant of blackjack may be accepted from a player by receiving a physical wagering element within the first designated area 118 in the player's player position 112 on the playing surface 110. A side wager may be accepted from the player by receiving another physical wagering element within the second designated area 120 in the player's player position 112 on the playing surface 110.

A round of the base game may be administered. In some embodiments, administering the base game may involve administering a game of blackjack or a variant of blackjack. For example, a set of randomized, physical cards located within a card-handling device (e.g., a shuffler or shoe), including at least a 52-card deck of standard playing cards (e.g., six or eight combined decks of such cards), may be provided. Two cards may be withdrawn from the card-handling device and placed, face up, in an area 116 of each player position 112. Two cards may be withdrawn from the card-handling device and placed, one face up and one face down, in the dealer area 114.

Lammers may be presented during the course of the round of the base game. For example, when a player election to double is accepted, a physical lammer 126 may be placed in the third designated area 122 in the player position 112 of the player who elected to double in some embodiments. In some embodiments, no additional wagering elements from the player may be required to successfully double, and the lammer 126 may act as a stand-in for the additional wagering element that would otherwise be required to double. In some such embodiments, no additional value may be required when a player elects to double after being dealt an initial hand of a predetermined point value or higher. More specifically, no additional value may be required when a player elects to double after being dealt an initial hand having a point value of, for example, 9 or higher. After the lammer 126 has been presented, one, and only one, additional card may be dealt from the card-handling device in the area 116 of the player's player position 112.

When two cards of the same scoring value according to the rules of blackjack or the variant of blackjack have been dealt to a player, that player's election to split may be accepted. A physical lammer 126 may be placed in the third designated area 122 in the player position 112 of the player who elected to split in some embodiments. In some embodiments, no additional wagering elements from the player may be required to successfully split, and the lammer 126 may act as a stand-in for the additional wagering element that would otherwise be required to split. In some such embodiments, no additional value may be required when a player elects to split after being dealt an initial hand of cards, wherein each card has a predetermined point value or lower. More specifically, no additional value may be required when a player elects to double after being dealt an initial hand of cards, wherein each card has a point value of, for example, 9 or lower.

After the lammer 126 has been presented, the cards may be separated from one another and played as separate hands. Accordingly an additional card may be dealt to each hand from the card-handling device. Doubling after any split may be permitted. In addition, resplitting may also be permitted, although a house limit may be imposed on resplitting without wagering additional value in connection with the split. For example, resplitting may be permitted up to a maximum of four occurrences without requiring the risk of additional value.

The round of the game of blackjack or variant of blackjack may be played to completion, including accepting player instructions to hit, stand, double, split, resplit, and surrender (where applicable and permitted), dealing additional cards when required by the rules, and presenting lammers 126 when required by the rules.

In some embodiments, the rules for the game of blackjack or variant of blackjack may require that one or more lammers be presented in response to other chance events, other player elections, or other player elections made in response to chance events. In embodiments where the base game is not blackjack or a variant of blackjack, the base game may be administered according to its rules, including rules governing when to present lammers and which lammers are qualifying lammers for a given side wager.

The side wager may be resolved by determining whether any qualifying lammers 126 have been presented. More specifically, the side wager may be resolved by, for example, determining whether any lammers 126 have been placed in the player position 112 (e.g., in the third designated area 122) of the player who made the side wager (e.g., by visually inspecting the player position 112 or by electronically detecting any lammers 126 in the player position 112 using a sensor or camera).

A payout may be paid on the side wager to the player when one or more qualifying lammers 126 has been presented by transferring additional, physical wagering elements to the player (e.g., in the player's player position 112). The side wager may be collected for the house when no qualifying lammers 126 have been presented by retrieving each wagering element associated with the side wager from the player position 112 (e.g., from the second designated area 120.

The base game wager may be resolved according to the rules of the base game, and any payouts and collections may be made accordingly.

In some embodiments, the wagering games described herein may be played against a game administrator (i.e., against "the house" such that the game is "house-banked"). Such implementations may involve the game administrator (e.g., a casino or other gaming establishment) accepting (e.g., via a dealer or other agent of the administrator) wagers of real-world monetary value, distributing payouts of real-world monetary value on winning wagers to players, and collecting real-world monetary value of lost wagers. Such "house-banked" embodiments may be implemented, for example, in the form of a live table game, in a virtual table game, in an electronic game, or in a networked (e.g., Internet) game configuration.

In other embodiments, the wagering games, or at least one wager associated with the wagering games, may involve a player in a casino or other gaming establishment acting as banker, accepting wagers having real-world monetary value, issuing payouts having real-world monetary value, and collecting real-world monetary value of lost wagers (i.e., be "player-banked"). In some embodiments where at least one wager is player-banked, the game administrator may collect a player entrance fee, or a rake on each player-banked wager accepted from the participating players, including the banker.

Figure 4:
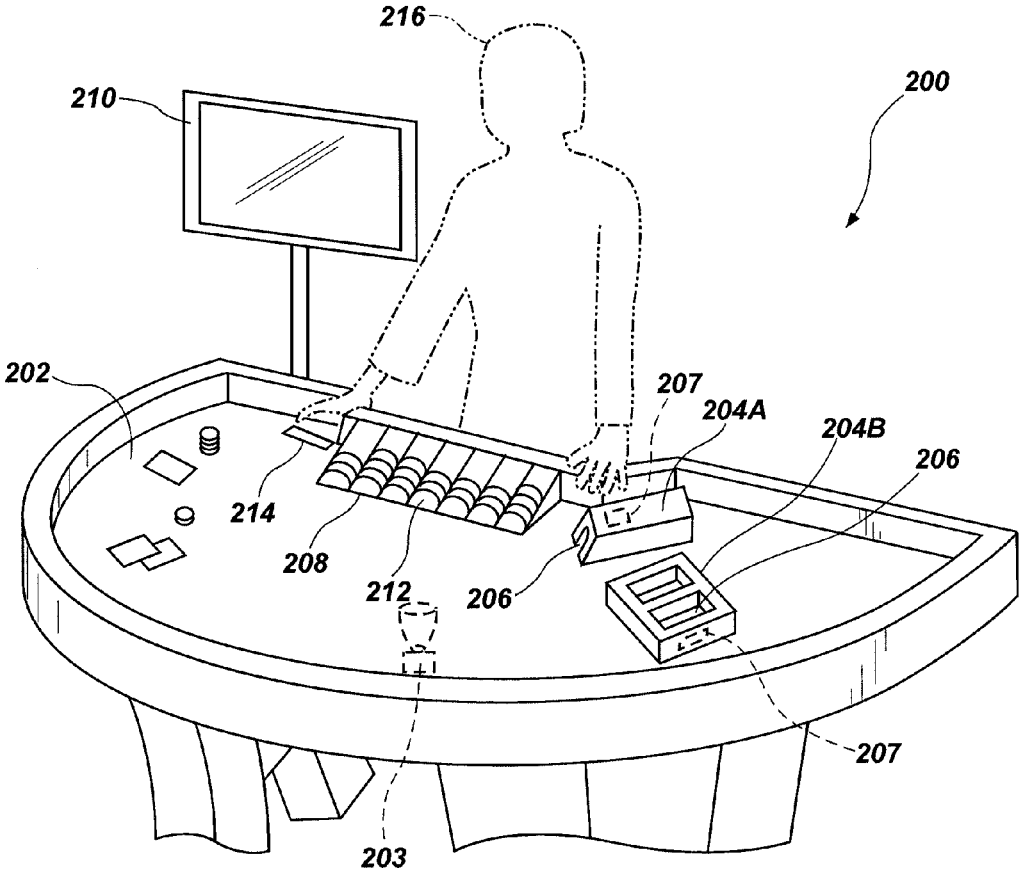
FIG. 4 is a perspective view of a gaming table configured for implementation of embodiments of wagering games in accordance with this disclosure.

FIG. 4 is a perspective view of an embodiment of a gaming table 200 for implementing wagering games in accordance with this disclosure. The gaming table 200 may be a physical article of furniture around which participants in the wagering game may stand or sit and on which the physical objects used for administering and otherwise participating in the wagering game may be supported, positioned, moved, transferred, and otherwise manipulated. For example, the gaming table 200 may include a gaming surface 202 on which the physical objects used in administering the wagering game may be located. The gaming surface 202 may be, for example, a felt fabric covering a hard surface of the table, and a design, conventionally referred to as a "layout," specific to the game being administered may be physically printed on the gaming surface 202. As another example, the gaming surface 202 may be a surface of a transparent or translucent material (e.g., glass or plexiglass) onto which a projector 203, which may be located, for example, above or below the gaming surface 202, may illuminate a layout specific to the wagering game being administered. In such an example, the specific layout projected onto the gaming surface 202 may be changeable, enabling the gaming table 200 to be used to administer different variations of wagering games within the scope of this disclosure or other wagering games. Additional details of illustrative gaming surfaces and projectors are disclosed in U.S. patent application Ser. No. 13/919,849, filed Jun. 17, 2013, and titled "ELECTRONIC GAMING DISPLAYS, GAMING TABLES INCLUDING ELECTRONIC GAMING DISPLAYS AND RELATED ASSEMBLIES, SYSTEMS AND METHODS," the disclosure of which is incorporated herein in its entirety by this reference. In either example, the gaming surface 202 may include, for example, designated areas for player positions; areas in which one or more of player cards, dealer cards, or community cards may be dealt; areas in which wagers may be accepted; areas in which wagers may be grouped into pots; and areas in which rules, pay tables, and other instructions related to the wagering game may be displayed. As a specific, nonlimiting example, the gaming surface 202 may be configured as shown in FIGS. 2 and 3.

In some embodiments, the gaming table 200 may include a display 210 separate from the gaming surface 202. The display 210 may be configured to face players, prospective players, and spectators and may display, for example, rules, paytables, real-time game status, such as wagers accepted and cards dealt, historical game information, such as amounts won, amounts wagered, percentage of hands won, and notable hands achieved, and other instructions and information related to the wagering game. The display 210 may be a physically fixed display, such as a poster, in some embodiments. In other embodiments, the display 210 may change automatically in response to a stimulus (e.g., may be an electronic video monitor).

The gaming table 200 may include particular machines and apparatuses configured to facilitate the administration of the wagering game. For example, the gaming table 200 may include one or more card-handling devices 204. The card-handling device 204A may be, for example, a shoe from which physical cards 206 from one or more decks of playing cards may be withdrawn, one at a time. Such a card-handling device 204A may include, for example, a housing in which cards 206 are located, an opening from which cards 206 are removed, and a card-presenting mechanism (e.g., a moving weight on a ramp configured to push a stack of cards down the ramp) configured to continually present new cards 206 for withdrawal from the shoe. Additional details of an illustrative card-handling device 204A configured as a shoe are found in U.S. Patent App. Pub. No. 2010/0038849, published Feb. 18, 2010, and titled "INTELLIGENT AUTOMATIC SHOE AND CARTRIDGE," the disclosure of which is incorporated herein in its entirety by this reference.

The card-handling device 204B may be, for example, a shuffler configured to reorder physical cards 206 from one or more decks of playing cards and present randomized cards 206 for use in the wagering game. Such a card-handling device 204B may include, for example, a housing, a shuffling mechanism configured to shuffle cards, and card inputs and outputs (e.g., trays). Additional details of an illustrative card-handling device 204B configured as a shuffler are found in U.S. Pat. No. 8,070,574, issued Dec. 6, 2011, to Grauzer et al., the disclosure of which is incorporated herein in its entirety by this reference. Shufflers such as the devices disclosed in the '574 Patent may include card recognition capability and may form randomly ordered hands of a known composition within the shuffler. Additionally, game rules may also be programmed within the shuffler such that the processor of the shuffler is capable of identifying a winning hand prior to automatic delivery into an output tray. The card-handling device 204 may also be, for example, a combination shuffler and shoe in which the output for the shuffler is a shoe.

In some embodiments, the card-handling device 204 may be configured and programmed to administer at least a portion of a wagering game being played utilizing the card-handling device 204. For example, the card-handling device 204 may be programmed and configured to randomize a set of cards and present one or more cards for use according to game rules. More specifically, the card-handling device 204 may be programmed and configured to, for example, randomize a set of cards including one or more 52-card decks of standard playing cards and, optionally, any specialty cards (e.g., a cut card, bonus cards, wild cards, or other specialty cards). In some embodiments, the card-handling device 204 may present individual cards, one at a time, for withdrawal from the card-handling device 204. In other embodiments, the card-handling device 204 may present packets of cards representing a subset of the complete set of cards handled by the card-handling device 204 (e.g., individual hands, one hand at a time, a group of hands, a partial hand or hands and then additional cards as needed to complete the hand or hands, a hand or hands and any burn or specialty cards to be used in the same round as the hand or hands) for withdrawal from the card-handling device 204. In some such embodiments, the card-handling device 204 may accept dealer input, such as, for example, a number of replacement cards for discarded cards, a number of hit cards to add, or a number of partial hands to be completed. In other such embodiments, the device may accept a dealer input from a menu of game options indicating a game selection, which will select programming to deliver the requisite number of cards to the game, depending on the game rules. The game rules may be programmed into the memory of the shuffler processing system. In still other embodiments, the card-handling device 204 may present the complete set of randomized cards for withdrawal from the card-handling device 204. As specific, nonlimiting examples, the card-handling device 204 may present a packet of cards representing a single hand or a packet of cards representing a group of hands, each initial hand including two cards.

Packets of cards used as player hands, partial player hands, dealer hands, partial dealer hands, community cards, or other card groups may be formed internally within the shuffler, such as within an internal compartment, as described in the '574 patent, or may be formed in an output tray of the shuffler. For example, U.S. Pat. No. 6,698,756, issued Mar. 2, 2004, to Baker et al., describes such a device. Other suitable shufflers include U.S. Pat. No. 6,267,248, issued Jul. 31, 2001, to Johnson et al., which describes a shuffler that can form a random set of cards, such as a deck or multiple decks; U.S. Pat. No. 7,766,332, issued Aug. 3, 2010, to Grauzer et al., which describes forming groups of player and/or dealer cards in compartments within a shuffler; U.S. Patent App. Pub. No. 2014/0027979, published Jan. 30, 2014, to Stasson et al., which shows an alternate method of randomly forming a set of cards in a shuffler such as one or more decks of cards; and U.S. Pat. No. 6,588,750, issued Jul. 8, 2003, to Grauzer et al., which shows a device for randomizing a set of cards using a gripping, lifting and insertion sequence. The disclosure of each of the foregoing documents is incorporated herein in its entirety by this reference.

In some embodiments, the card-handling device 204 may employ a random number generator device to determine a final card order or an order of insertion of cards into a compartment configured to form a packet of cards. The compartments may be sequentially numbered, and a random number assigned to each compartment number prior to delivery of the first card. In other embodiments, the random number generator may select a location in the stack of cards to separate the stack into two sub-stacks, creating an insertion point within the stack at a random location. The next card may be inserted into the insertion point. In yet other embodiments, the random number generator may randomly select a location in a stack to randomly remove cards by activating an ejector.

Other functions of the random number generator may be game-specific. For example, a random number generator internal or external to the shuffler may be used to randomly select a player to receive a first packet of cards, including a hand or a portion of a hand, according to the game rules. In other examples, the random number generator may select a game position to receive an extra card, one less card, or a random number of cards, depending upon the specific rules of the game.

Regardless of whether the random number generator is hardware or software, it may be used to implement specific game administrations methods of the present disclosure.

The card-handling device 204 may simply be supported on the gaming surface 202 in some embodiments. In other embodiments, the card-handling device 204 may be mounted into the gaming table 202 such that the card-handling device 204 is not manually removable from the gaming table 202 without the use of tools. In some embodiments, the deck or decks of playing cards used may be standard, 52-card decks. In other embodiments, the deck or decks used may include cards, such as, for example, jokers, wild cards, bonus cards, etc. The shuffler may also be configured to handle and dispense security cards, such as cut cards.

In some embodiments, the card-handling device 204 may include an electronic display 207 for displaying information related to the wagering game being administered. For example, the electronic display 207 may display a menu of game options, the name of the game selected, the number of cards per hand to be dispensed, acceptable amounts for wagers (e.g., maximums and minimums), numbers of cards to be dealt to recipients, locations of particular recipients for particular cards, winning and losing wagers, pay tables, winning hands, losing hands, and payout amounts. In other embodiments, information related to the wagering game may be displayed on another electronic display, such as, for example, the display 210 described previously.

The type of card-handling device 204 employed to administer embodiments of the disclosed wagering game, as well as the type of card deck employed and the number of decks, may be specific to the game to be implemented. In embodiments where the base game is blackjack, a variant of blackjack, baccarat, a variant of baccarat, casino war, or a variant of casino war, the card-handling device 204 may be a shoe configured to present cards, in groups or one at a time, from a set of randomized cards including at least one 52-card deck of standard playing cards (e.g., six or eight combined decks of such cards and any wild, specialty, bonus, and cut cards). In embodiments where the base game is poker or a variant of poker, for example, the card-handling device 204 may be a combination shuffler and shoe configured to randomize a set of cards including at least one 52-card deck of standard playing cards (e.g., six or eight combined decks of such cards and any wild, specialty, bonus, and cut cards) and automatically present randomized cards (e.g., in groups or one at a time) for dealing.

The gaming table 200 may include one or more chip racks 208 configured to facilitate accepting wagers, transferring lost wagers to the house, and exchanging monetary value for wagering elements 212 (e.g., chips). For example, the chip rack 208 may include a series of token support rows, each of which may support tokens of a different type (e.g., color and denomination). In some embodiments, the chip rack 208 may be configured to automatically present a selected number of chips using a chip-cutting-and-delivery mechanism. Additional details of an illustrative chip rack 208 and chip-cutting-and-delivery mechanism are found in U.S. Pat. No. 7,934,980, issued May 3, 2011, to Blaha et al., the disclosure of which is incorporated herein in its entirety by this reference. In some embodiments, the gaming table 200 may include a drop box 214 for money that is accepted in exchange for wagering elements 212. The drop box 214 may be, for example, a secure container (e.g., a safe or lockbox) having a one-way opening into which money may be inserted and a secure, lockable opening from which money may be retrieved. Such drop boxes 214 are known in the art, and may be incorporated directly into the gaming table 200 and may, in some embodiments, have a removable container for the retrieval of money in a separate, secure location.

When administering a wagering game in accordance with embodiments of this disclosure, a dealer 216 may receive money (e.g., cash) from a player in exchange for wagering elements 212. The dealer 216 may deposit the money in the drop box 214 and transfer physical wagering elements 212 to the player. The dealer 216 may accept one or more initial wagers (e.g., antes and other wagers) from the player, which may be reflected by the dealer 216 permitting the player to place one or more wagering elements 212 or other wagering tokens (e.g., cash) within designated areas on the gaming surface 202 associated with the various wagers of the wagering game. Once initial wagers have been accepted, the dealer 216 may remove physical cards 206 from the card-handling device 204 (e.g., individual cards, packets of cards, or the complete set of cards) in some embodiments. In other embodiments, the physical cards 206 may be hand-pitched (i.e., the dealer may optionally shuffle the cards 206 to randomize the set and may hand-deal cards 206 from the randomized set of cards). The dealer may position cards 206 within designated areas on the gaming surface 202, which may designate the cards 206 for use as individual player cards, community cards, or dealer cards in accordance with game rules. House rules also may allow the player to place wagers during card distribution, or after card distribution, but before revealing the cards, in some embodiments.

After dealing the cards 206, and during play, according to the game rules, any additional wagers (e.g., play bets) may be accepted, which may be reflected by the dealer 216 permitting the player to place one or more wagering elements 212 within designated areas on the gaming surface 202 associated with the various wagers of the wagering game. In some embodiments, a player may fold, which may result in the dealer 216 collecting at least one of the wagering elements 212 from that player and transferring it to the house, which may be reflected by the wagering element 212 being returned to the chip rack 208. The dealer 216 may perform any additional card dealing and rounds of betting permitted in the wagering game. Finally, the dealer 216 may resolve the wagers, award winning wagers to the players, which may be accomplished by giving wagering elements 212 from the chip rack 208 to the players, and transferring losing wagers to the house, which may be accomplished by moving wagering elements 212 from the players to the chip rack 208.

Figure 5:
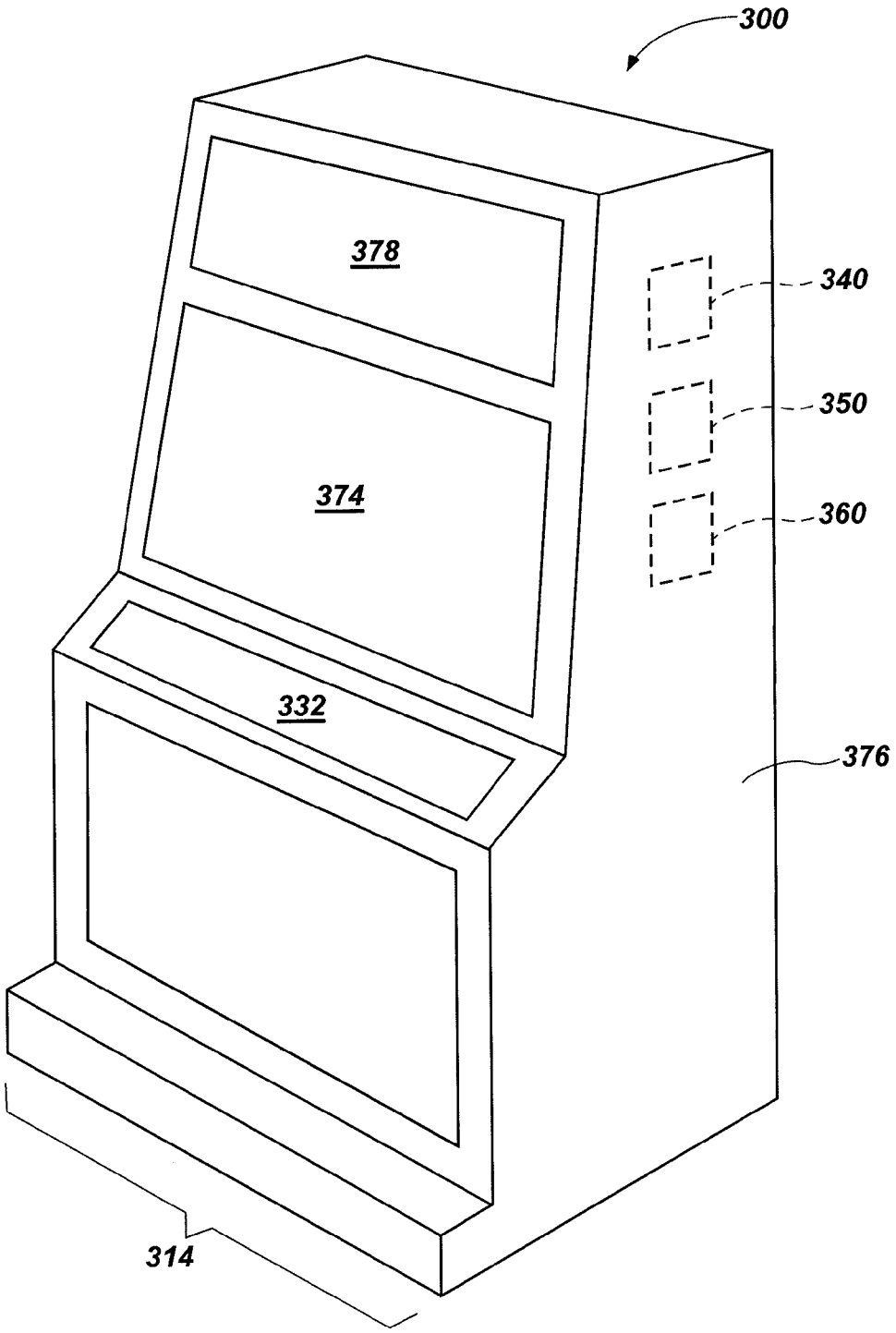
FIG. 5 is a perspective view of an individual electronic gaming device configured for implementation of embodiments of wagering games in accordance with this disclosure.

FIG. 5 is a perspective view of an individual electronic gaming device 300 (e.g., an electronic gaming machine (EGM)) configured for implementing wagering games according to this disclosure. The individual electronic gaming device 300 may include an individual player position 314 including a player input area 332 configured to enable a player to interact with the individual electronic gaming device 300 through various input devices (e.g., buttons, levers, touchscreens). The individual electronic gaming device 300 may include a gaming screen 374 configured to display indicia for interacting with the individual electronic gaming device 300, such as through processing one or more programs stored in memory 340 to implement the rules of game play at the individual electronic gaming device 300. Accordingly, game play may be accommodated without involving physical playing cards, chips or other wagering elements, and live personnel. The action may instead be simulated by a control processor 350 operably coupled to the memory 340 and interacting with and controlling the individual electronic gaming device 300.

Although the individual electronic gaming device 300 displayed in FIG. 5 has an outline of a traditional gaming cabinet, the individual electronic gaming device 300 may be implemented in other ways, such as, for example, client software downloaded to a portable device, such as a smart phone, tablet, or laptop computer. The individual electronic gaming device 300 may also be a non-portable personal computer (e.g., a desktop or all-in-one computer) or other computing device. In some embodiments, client software is not downloaded but is native to the device or is otherwise delivered with the device when distributed.

A communication device 360 may be included and operably coupled to the processor 350 such that information related to operation of the individual electronic gaming device 300, information related to the game play, or combinations thereof may be communicated between the individual electronic gaming device 300 and other devices, such as a server, through a suitable communication medium, such as, for example, wired networks, Wi-Fi networks, and cellular communication networks.

The gaming screen 374 may be carried by a generally vertically extending cabinet 376 of the individual electronic gaming device 300. The individual electronic gaming device 300 may further include banners to communicate rules of game play and the like, such as along a top portion 378 of the cabinet 376 of the individual electronic gaming device 300. The individual electronic gaming device 300 may further include additional decorative lights (not shown), and speakers (not shown) for transmitting and optionally receiving sounds during game play. Further detail of an example of an individual electronic gaming device 300 (as well as other embodiments of tables and devices) is disclosed in U.S. patent application Ser. No. 13/963,165, filed Aug. 9, 2013, and titled "METHODS AND SYSTEMS FOR ELECTRONIC GAMING," the disclosure of which is incorporated herein in its entirety by this reference.

Some embodiments may be implemented at locations including a plurality of player stations. Such player stations may include an electronic display screen for display of game information (e.g., cards, wagers, and game instructions) and for accepting wagers and facilitating credit balance adjustments. Such player stations may, optionally, be integrated in a table format, may be distributed throughout a casino or other gaming site, or may include both grouped and distributed player stations.

Figure 6:
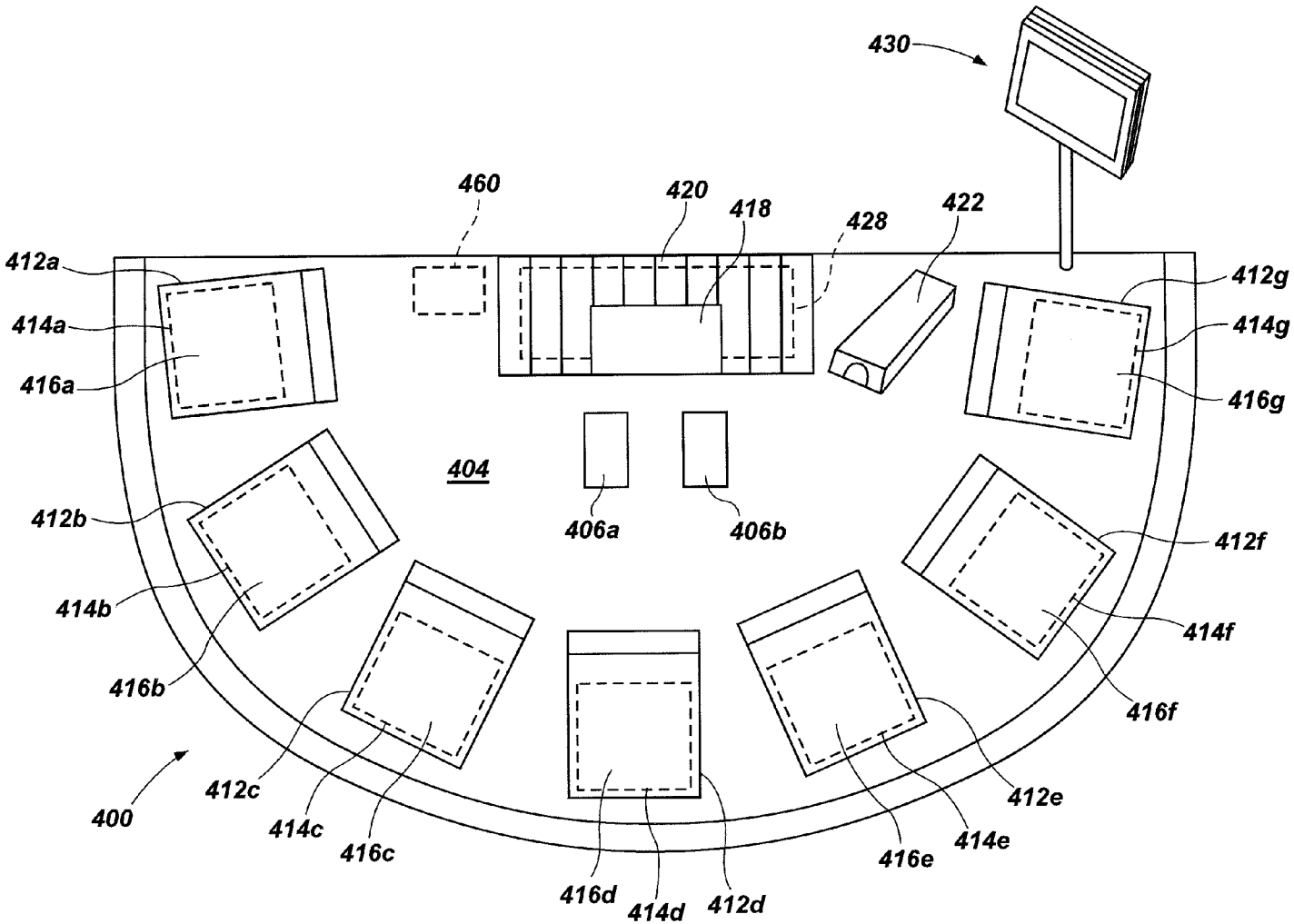
FIG. 6 is a top view of a table configured for implementation of embodiments of wagering games in accordance with this disclosure.

FIG. 6 is a top view of a suitable table 400 configured for implementing wagering games according to this disclosure. The table 400 may include a playing surface 404. The table 400 may include player stations 412. Each player station 412 may include a player interface 416, which may be used for displaying game information (e.g., game instructions, input options, wager information, game outcomes, etc.) and accepting player elections. The player interface 416 may be a display screen in the form of a touch screen, which may be at least substantially flush with the playing surface 404 in some embodiments. Each player interface 416 may be operated by its own local game processor 414 (shown in dashed lines), although, in some embodiments, a central game processor 428 (shown in dashed lines) may be employed and may communicate directly with player interfaces 416. In some embodiments, a combination of individual local game processors 414 and the central game processor 428 may be employed. Each of the processors 414 and 428 may be operably coupled to memory including one or more programs related to the rules of game play at the table 400.

A communication device 460 may be included and may be operably coupled to one or more of the local game processors 414, the central game processor 428, or combinations thereof, such that information related to operation of the table 400, information related to the game play, or combinations thereof may be communicated between the table 400 and other devices through a suitable communication medium, such as, for example, wired networks, Wi-Fi networks, and cellular communication networks.

The table 400 may further include additional features, such as a dealer chip tray 420, which may be used by the dealer to cash players in and out of the wagering game, whereas wagers and balance adjustments during game play may be performed using, for example, virtual chips (e.g., images or text representing wagers). For embodiments using physical cards 406*a* and 406*b*, the table 400 may further include a card-handling device 422, which may be configured to shuffle, read, and deliver physical cards for the dealer and players to use during game play or, alternatively, a card shoe configured to read and deliver cards that have already been randomized. For embodiments using virtual cards, the virtual cards may be displayed at the individual player interfaces 416. Common virtual cards may be displayed in a common card area.

The table 400 may further include a dealer interface 418, which, like the player interfaces 416, may include touch screen controls for receiving dealer inputs and assisting the dealer in administering the wagering game. The table 400 may further include an upright display 430 configured to display images that depict game information such as pay tables, hand counts, historical win/loss information by player, and a wide variety of other information considered useful to the players. The upright display 430 may be double sided to provide such information to players as well as to casino personnel.

Further detail of an example of a table and player displays is disclosed in U.S. Pat. No. 8,262,475, issued Sep. 11, 2012, and titled "CHIPLESS TABLE SPLIT SCREEN FEATURE," the disclosure of which is incorporated herein in its entirety by this reference. Although an embodiment is described showing individual discrete player stations, in some embodiments, the entire playing surface 404 may be an electronic display that is logically partitioned to permit game play from a plurality of players for receiving inputs from, and displaying game information to, the players, the dealer, or both.

Figure 7:
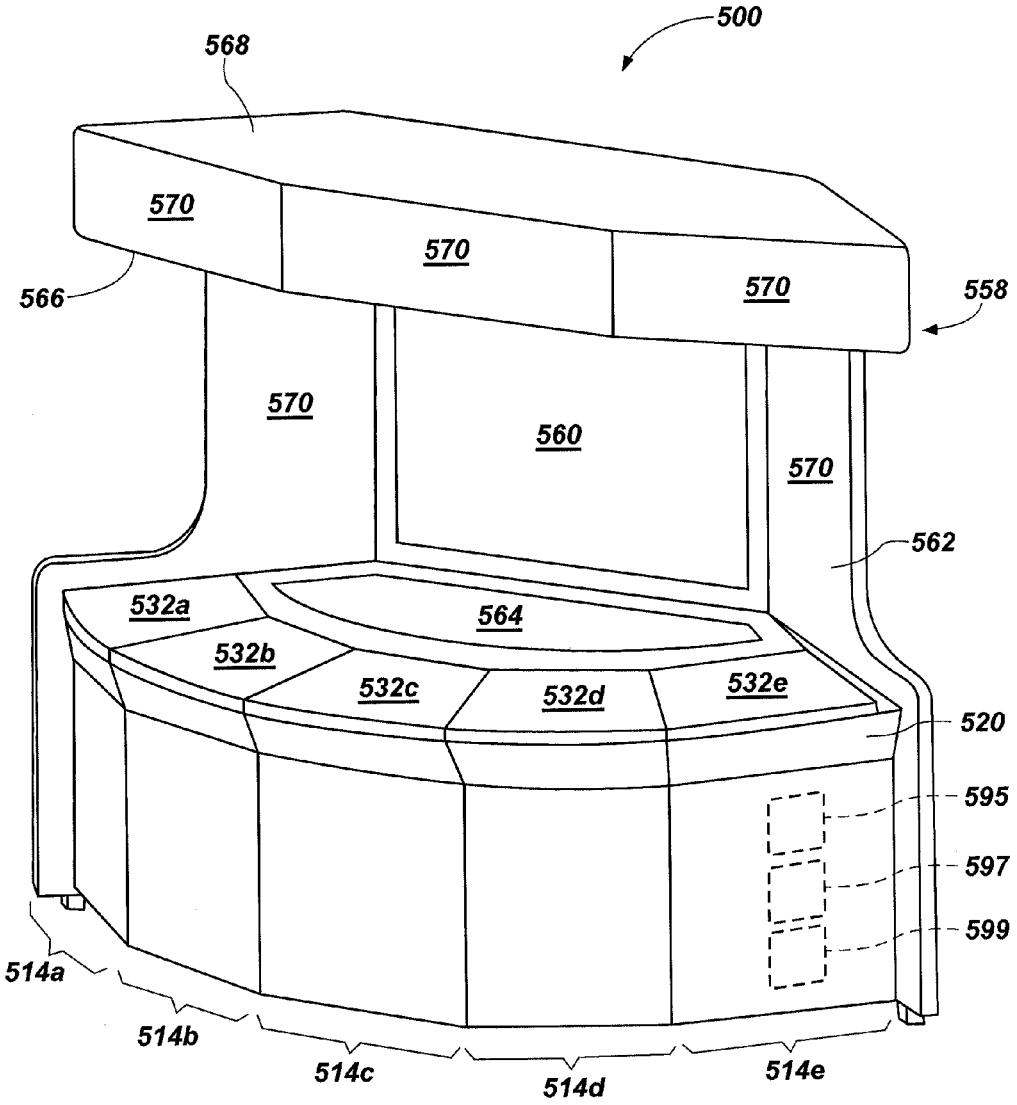
FIG. 7 is a perspective view of another embodiment of a table configured for implementation of embodiments of wagering games in accordance with this disclosure, wherein the implementation includes a virtual dealer.

FIG. 7 is a perspective view of another embodiment of a suitable table 500 configured for implementing wagering games according to the present disclosure utilizing a virtual dealer. The table 500 may include player positions 514 arranged in a bank about an arcuate edge 520 of a video device 558 that may comprise a card screen 564 and a dealer screen 560. The dealer screen 560 may display a video simulation of the dealer (i.e., a virtual dealer) for interacting with the video device 558, such as through processing one or more stored programs stored in memory 595 to implement the rules of game play at the video device 558. The dealer screen 560 may be carried by a generally vertically extending cabinet 562 of the video device 558. The card screen 564 may be configured to display at least one or more of the dealer's cards, any community cards, and player's cards by the virtual dealer on the dealer screen 560.

Each of the player positions 514 may include a player interface area 532 configured for wagering and game play interactions with the video device 558 and virtual dealer. Accordingly, game play may be accommodated without involving physical playing cards, poker chips, and live personnel. The action may instead be simulated by a control processor 597 interacting with and controlling the video device 558. The control processor 597 may be programmed, by known techniques, to implement the rules of game play at the video device 558. As such, the control processor 597 may interact and communicate with display/input interfaces and data entry inputs for each player interface area 532 of the video device 558. Other embodiments of tables and gaming devices may include a control processor that may be similarly adapted to the specific configuration of its associated device.

A communication device 599 may be included and operably coupled to the control processor 597 such that information related to operation of the table 500, information related to the game play, or combinations thereof may be communicated between the table 500 and other devices, such as a central server, through a suitable communication medium, such as, for example, wired networks, Wi-Fi networks, and cellular communication networks.

The video device 558 may further include banners communicating rules of play and the like, which may be located along one or more walls 570 of the cabinet 562. The video device 558 may further include additional decorative lights and speakers, which may be located on an underside surface 566, for example, of a generally horizontally extending top 568 of the cabinet 562 of the video device 558 generally extending toward the player positions 514.

Further detail of an example of a table and player displays is disclosed in U.S. Pat. No. 8,272,958, issued Sep. 25, 2012, and titled "AUTOMATED MULTIPLAYER GAME TABLE WITH UNIQUE IMAGE FEED OF DEALER," the disclosure of which is incorporated herein in its entirety by this reference. Although an embodiment is described showing individual discrete player stations, in some embodiments, the entire playing surface (e.g., player interface areas 532, card screen 564, etc.) may be a unitary electronic display that is logically partitioned to permit game play from a plurality of players for receiving inputs from, and displaying game information to, the players, the dealer, or both.

Figure 8:
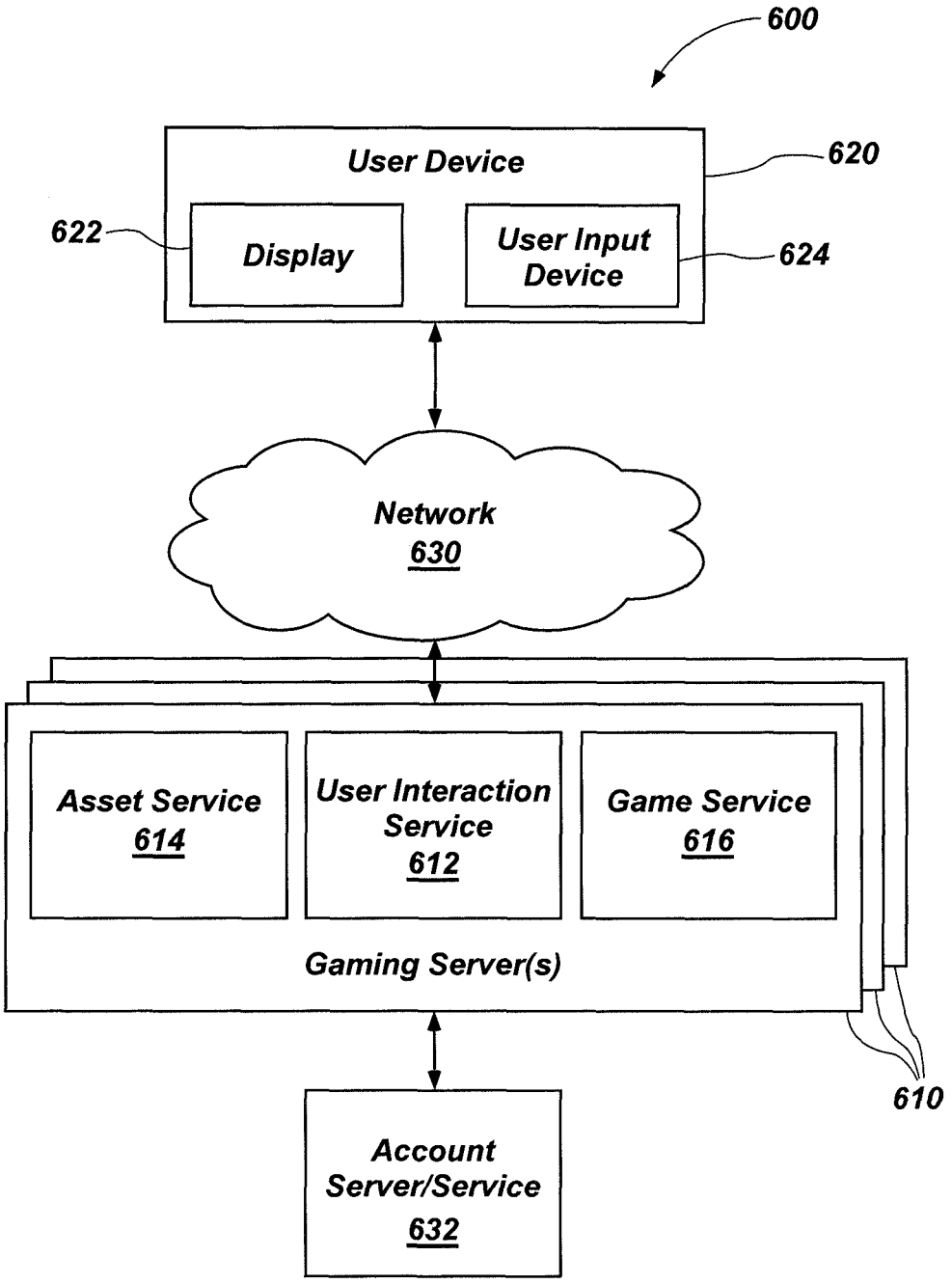
FIG. 8 is a schematic block diagram of a gaming system for implementing embodiments of waging games in accordance with this disclosure.

In some embodiments, wagering games in accordance with this disclosure may be administered using a gaming system employing a client-server architecture (e.g., over the Internet, a local area network, etc.). FIG. 8 is a schematic block diagram of an illustrative gaming system 600 for implementing wagering games according to this disclosure. The gaming system 600 may enable end users to remotely access game content. Such game content may include, without limitation, various types of wagering games such as card games, dice games, big wheel games, roulette, scratch off games ("scratchers"), and any other wagering game where the game outcome is determined, in whole or in part, by one or more random events. This includes, but is not limited to, Class II and Class III games as defined under 25 U.S.C. §2701 et seq. ("Indian Gaming Regulatory Act"). Such games may include banked and/or non-banked games.

The wagering games supported by the gaming system 600 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This feature may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 600 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 600 may include a gaming platform to establish a portal for an end user to access a wagering game hosted by one or more gaming servers 610 over a network 630. In some embodiments, games are accessed through a user interaction service 612. The gaming system 600 enables players to interact with a user device 620 through a user input device 624 and a display 622 and to communicate with one or more gaming servers 610 using a network 630 (e.g., the Internet). Typically, the user device is remote from the gaming server 610 and the network is the word-wide web (i.e., the Internet).

In some embodiments, the gaming servers 610 may be configured as a single server to administer wagering games in combination with the user device 620. In other embodiments, the gaming servers 610 may be configured as separate servers for performing separate, dedicated functions associated with administering wagering games. Accordingly, the following description also discusses "services" with the understanding that the various services may be performed by different servers or combinations of servers in different embodiments. As shown in FIG. 8, the gaming servers 610 may include a user interaction service 612, a game service 616, and an asset service 614. In some embodiments, one or more of the gaming servers 610 may communicate with an account server 632 performing an account service 632. As explained more fully below, for some wagering type games, the account service 632 may be separate and operated by a different entity than the gaming servers 610; however, in some embodiments the account service 632 may also be operated one or more of the gaming servers 610.

The user device 620 may communicate with the user interaction service 612 through the network 630. The user interaction service 612 may communicate with the game service 616 and provide game information to the user device 620. In some embodiments, the game service 616 may also include a game engine. The game engine may, for example, access, interpret, and apply game rules. In some embodiments, a single user device 620 communicates with a game provided by the game service 616, while other embodiments may include a plurality of user devices 620 configured to communicate and provide end users with access to the same game provided by the game service 616. In addition, a plurality of end users may be permitted to access a single user interaction service 612, or a plurality of user interaction services 612, to access the game service 616. The user interaction service 612 may enable a user to create and access a user account and interact with game service 616. The user interaction service 612 may enable users to initiate new games, join existing games, and interface with games being played by the user.

The user interaction service 612 may also provide a client for execution on the user device 620 for accessing the gaming servers 610. The client provided by the gaming servers 610 for execution on the user device 620 may be any of a variety of implementations depending on the user device 620 and method of communication with the gaming servers 610. In one embodiment, the user device 620 may connect to the gaming servers 610 using a web browser, and the client may execute within a browser window or frame of the web browser. In another embodiment, the client may be a stand-alone executable on the user device 620.

For example, the client may comprise a relatively small amount of script (e.g., JAVASCRIPT®), also referred to as a "script driver," including scripting language that controls an interface of the client. The script driver may include simple function calls requesting information from the gaming servers 610. In other words, the script driver stored in the client may merely include calls to functions that are externally defined by, and executed by, the gaming servers 610. As a result, the client may be characterized as a "thin client." The client may simply send requests to the gaming servers 610 rather than performing logic itself The client may receive player inputs, and the player inputs may be passed to the gaming servers 610 for processing and executing the wagering game. In some embodiments, this may involve providing specific graphical display information for the display 622 as well as game outcomes.

As another example, the client may comprise an executable file rather than a script. The client may do more local processing than does a script driver, such as calculating where to show what game symbols upon receiving a game outcome from the game service 616 through user interaction service 612. In some embodiments, portions of an asset service 614 may be loaded onto the client and may be used by the client in processing and updating graphical displays. Some form of data protection, such as end-to-end encryption, may be used when data is transported over the network 630. The network 630 may be any network, such as, for example, the Internet or a local area network.

The gaming servers 610 may include an asset service 614, which may host various media assets (e.g., text, audio, video, and image files) to send to the user device 620 for presenting the various wagering games to the end user. In other words, the assets presented to the end user may be stored separately from the user device 620. For example, the user device 620 requests the assets appropriate for the game played by the user; as another example, especially relating to thin clients, just those assets that are needed for a particular display event will be sent by the gaming servers 610, including as few as one asset. The user device 620 may call a function defined at the user interaction service 612 or asset service 614, which may determine which assets are to be delivered to the user device 620 as well as how the assets are to be presented by the user device 620 to the end user. Different assets may correspond to the various user devices 620 and their clients that may have access to the game service 616 and to different variations of wagering games.

The gaming servers 610 may include the game service 616, which may be programmed to administer wagering games and determine game play outcomes to provide to the user interaction service 612 for transmission to the user device 620. For example, the game service 616 may include game rules for one or more wagering games, such that the game service 616 controls some or all of the game flow for a selected wagering game as well as the determined game outcomes. The game service 616 may include pay tables and other game logic. The game service 616 may perform random number generation for determining random game elements of the wagering game. In one embodiment, the game service 616 may be separated from the user interaction service 612 by a firewall or other method of preventing unauthorized access to the game service 612 by the general members of the network 630.

The user device 620 may present a gaming interface to the player and communicate the user interaction from the user input device 624 to the gaming servers 610. The user device 620 may be any electronic system capable of displaying gaming information, receiving user input, and communicating the user input to the gaming servers 610. For example, the user device 620 may be a desktop computer, a laptop, a tablet computer, a set-top box, a mobile device (e.g., a smartphone), a kiosk, a terminal, or another computing device. As a specific, nonlimiting example, the user device 620 operating the client may be an interactive electronic gaming system 300 (see FIG. 5), as described above. The client may be a specialized application or may be executed within a generalized application capable of interpreting instructions from an interactive gaming system, such as a web browser.

The client may interface with an end user through a web page or an application that runs on a device including, but not limited to, a smartphone, a tablet, or a general computer, or the client may be any other computer program configurable to access the gaming servers 610. The client may be illustrated within a casino webpage (or other interface) indicating that the client is embedded into a webpage, which is supported by a web browser executing on the user device 620.

In some embodiments, components of the gaming system 600 may be operated by different entities. For example, the user device 620 may be operated by a third party, such as a casino or an individual, that links to the gaming servers 610, which may be operated, for example, by a wagering game service provider. Therefore, in some embodiments, the user device 620 and client may be operated by a different administrator than the operator of the game service 616. In other words, the user device 620 may be part of a third-party system that does not administer or otherwise control the gaming servers 610 or game service 616. In other embodiments, the user interaction service 612 and asset service 614 may be operated by a third-party system. For example, a gaming entity (e.g., a casino) may operate the user interaction service 612, user device 620, or combination thereof to provide its customers access to game content managed by a different entity that may control the game service 616, amongst other functionality. In still other embodiments, all functions may be operated by the same administrator. For example, a gaming entity (e.g., a casino) may elect to perform each of these functions in-house, such as providing access to the user device 620, delivering the actual game content, and administering the gaming system 600.

The gaming servers 610 may communicate with one or more external account servers 632 (also referred to herein as an account service 632), optionally through another firewall. For example, the gaming servers 610 may not directly accept wagers or issue payouts. That is, the gaming servers 610 may facilitate online casino gaming but may not be part of a self-contained online casino itself. Another entity (e.g., a casino or any account holder or financial system of record) may operate and maintain its external account service 632 to accept bets and make payout distributions. The gaming servers 610 may communicate with the account service 632 to verify the existence of funds for wagering and to instruct the account service 632 to execute debits and credits. As another example, the gaming servers 610 may directly accept bets and make payout distributions, such as in the case where an administrator of the gaming servers 610 operates as a casino.

Additional features may be supported by the gaming servers 610, such as hacking and cheating detection, data storage and archival, metrics generation, messages generation, output formatting for different end user devices, as well as other features and operations. For example, the gaming servers 610 may include additional features and configurations as described in U.S. patent application Ser. No. 13/353,194, filed Jan. 18, 2012, and U.S. patent application Ser. No. 13/609,031, filed Sep. 10, 2012, both applications titled "NETWORK GAMING ARCHITECTURE, GAMING SYSTEMS, AND RELATED METHODS," the disclosure of each of which is incorporated herein in its entirety by this reference.

Figure 9:
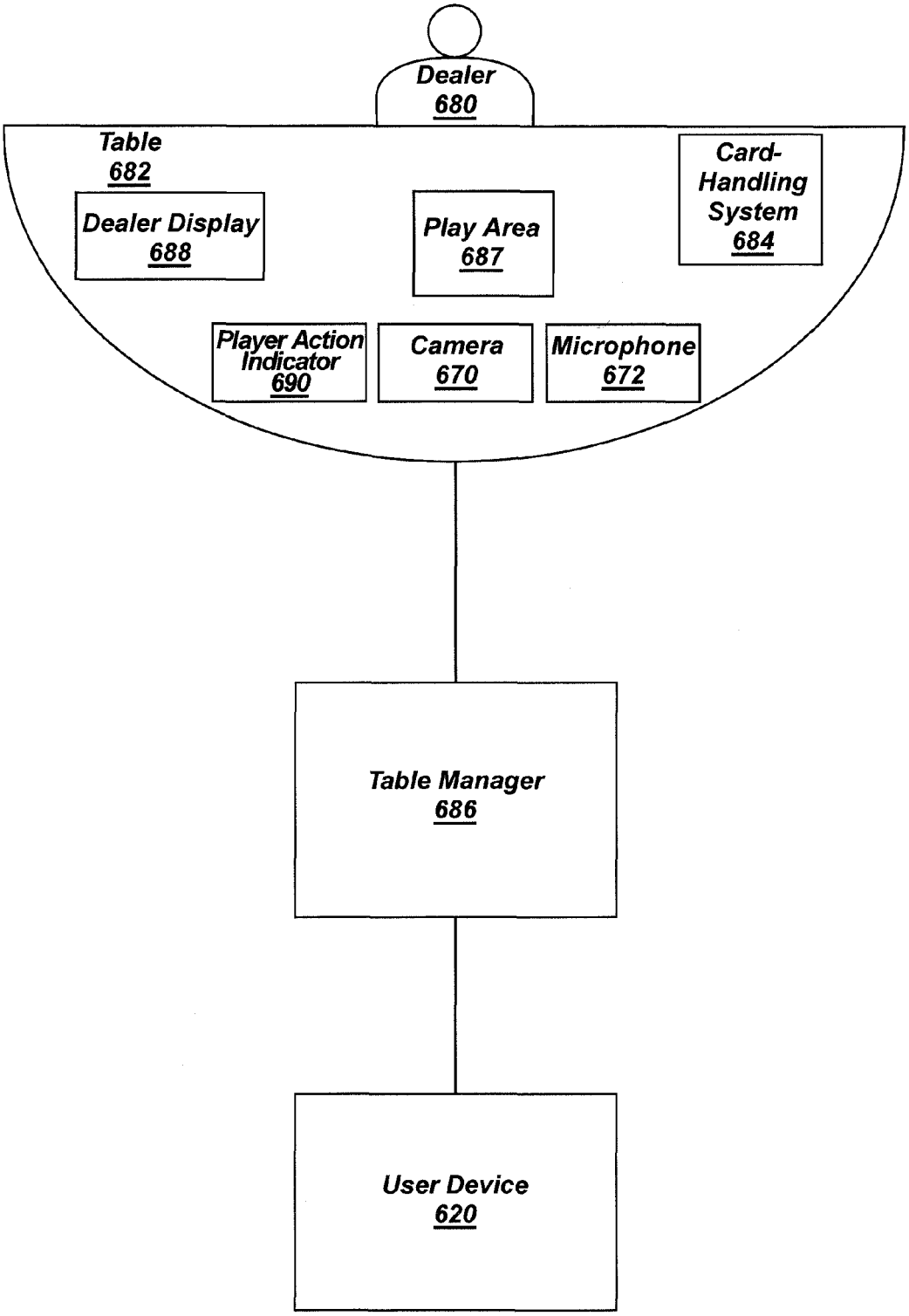
FIG. 9 is a schematic block diagram of a gaming system for implementing embodiments of wagering games including a live dealer feed.

FIG. 9 is a schematic block diagram of a table 682 for implementing wagering games including a live dealer feed. Features of the gaming system 600 (see FIG. 8) described above in connection with FIG. 8 may be utilized in connection with this embodiment, except as further described. Rather than cards being determined by a computerized random processes, physical cards (e.g., from a standard, 52-card deck of playing cards) may be dealt by a live dealer 680 at a table 682 from a card-handling system 684. A table manager 686 may assist the dealer 680 in facilitating play of the game by transmitting a video feed of the dealer's actions to the user device 620 and transmitting player elections to the dealer 680. As described above, the table manager 686 may act as or communicate with a gaming system 600 (see FIG. 8) (e.g., acting as the gaming system 600 (see FIG. 8) itself or as an intermediate client interposed between and operationally connected to the user device 620 and the gaming system 600 (see FIG. 8)) to provide gaming at the table 682 to users of the gaming system 600 (see FIG. 8). Thus, the table manager 686 may communicate with the user device 620 through a network 630 (see FIG. 8), and may be a part of a larger online casino, or may be operated as a separate system facilitating game play. In various embodiments, each table 682 may be managed by an individual table manager 686 constituting a gaming device, which may receive and process information relating to that table. For simplicity of description, these functions are described as being performed by the table manager 686, though certain functions may be performed by an intermediary gaming system 600 (see FIG. 8), such as the one shown and described in connection with FIG. 8. In some embodiments, the gaming system 600 (see FIG. 8) may match remotely located players to tables 682 and facilitate transfer of information between user devices 620 and tables 682, such as wagering amounts and player option elections, without managing gameplay at individual tables. In other embodiments, functions of the table manager 686 may be incorporated into a gaming system 600 (see FIG. 8).

The table 682 includes a camera 670 and optionally a microphone 672 to capture video and audio feeds relating to the table 682. The camera 670 may be trained on the dealer 680, play area 687, and card-handling system 684. As the game is administered by the dealer 680, the video feed captured by the camera 670 may be shown to the player using the user device 620, and any audio captured by the microphone 672 may be played to the player using the user device 620. In some embodiments, the user device 620 may also include a camera, microphone, or both, which may also capture feeds to be shared with the dealer 680 and other players. In some embodiments, the camera 670 may be trained to capture images of the card faces, chips, and chip stacks on the surface of the gaming table. Known image extraction techniques may be used to obtain card count and card rank and suit information from the card images. An example of suitable image extraction software is disclosed in U.S. Pat. No. 7,901,285, issued Mar. 8, 2011, to Tran et al., the disclosure of which is incorporated in this disclosure in its entirety by this reference.

Card and wager data in some embodiments may be used by the table manager 686 to determine game outcome. The data extracted from the camera 670 may be used to confirm the card data obtained from the card-handling system 684, to determine a player position that received a card, and for general security monitoring purposes, such as detecting player or dealer card switching, for example. Examples of card data include, for example, suit and rank information of a card, suit and rank information of each card in a hand, rank information of a hand, and rank information of every hand in a round of play.

The live video feed permits the dealer to show cards dealt by the card-handling system and play the game as though the player were at a live casino. In addition, the dealer can prompt a user by announcing a player's election is to be performed. In embodiments where a microphone 672 is included, the dealer 680 can verbally announce action or request an election by a player. In some embodiments, the user device 620 also includes a camera or microphone, which also captures feeds to be shared with the dealer 680 and other players.

The card-handling system 684 may be as shown and described previously in connection with FIG. 4. The play area 686 depicts player positions for playing the game, such as shown in FIGS. 2 and 3. As determined by the rules of the game, the player at the user device 620 may be presented options for responding to an event in the game using a client as described with reference to FIG. 8.

Player elections may be transmitted to the table manager 686, which may display player elections to the dealer 680 using a dealer display 688 and player action indicator 690 on the table 682. For example, the dealer display 688 may display information regarding where to deal the next card or which player position is responsible for the next action.

In some embodiments, the table manager 686 may receive card information from the card-handling system 684 to identify cards dealt by the card-handling system 684. For example, the card-handling system 684 may include a card reader to determine card information from the cards. The card information may include the rank and suit of each dealt card and hand information.

The table manager 686 may apply game rules to the card information, along with the accepted player decisions, to determine gameplay events and wager results. Alternatively, the wager results may be determined by the dealer 680 and input to the table manager 686, which may be used to confirm automatically determined results by the gaming system.

Card and wager data in some embodiments may be used by the table manager 686 to determine game outcome. The data extracted from the camera 670 may be used to confirm the card data obtained from the card-handling system 684, to determine a player position that received a card, and for general security monitoring purposes, such as detecting player or dealer card switching, for example.

The live video feed permits the dealer to show cards dealt by the card-handling system and play the game as though the player were at a live casino. In addition, the dealer can prompt a user by announcing a player's election is to be performed. In embodiments where a microphone 672 is included, the dealer 680 can verbally announce action or request an election by a player. In some embodiments, the user device 620 also includes a camera or microphone, which also captures feeds to be shared with the dealer 680 and other players.

Figure 10:
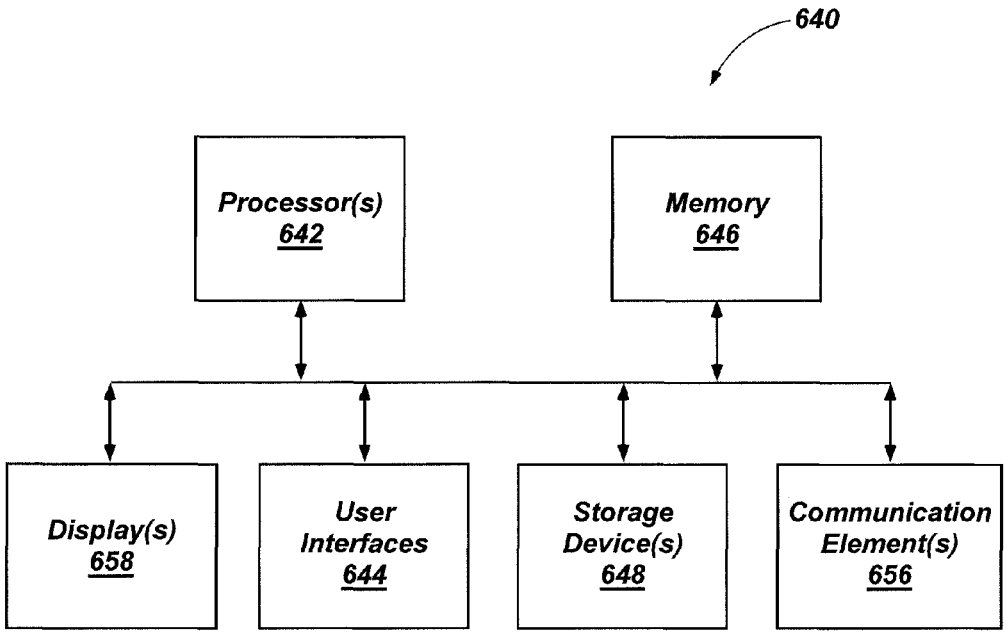
FIG. 10 is a block diagram of a computer for acting as a gaming system for implementing embodiments of wagering games in accordance with this disclosure.

FIG. 10 is a simplified block diagram showing elements of computing devices that may be used in systems and apparatuses of this disclosure. The computing system 640 may be a user-type computer, a file server, a computer server, a notebook computer, a tablet, a handheld device, a mobile device, or other similar computer system for executing software. The computing system 640 may be configured to execute software programs containing computing instructions and may include one or more processors 642, memory 646, one or more displays 658, one or more user interface elements 644, one or more communication elements 656, and one or more storage devices 648 (also referred to herein simply as storage 648).

The processors 642 may be configured to execute a wide variety of operating systems and applications including the computing instructions for administering wagering games of the present disclosure.

The processors 642 may be configured as a general-purpose processor such as a microprocessor, but in the alternative, the general-purpose processor may be any processor, controller, microcontroller, or state machine suitable for carrying out processes of the present disclosure. The processor 642 may also be implemented as a combination of computing devices, such as a combination of a DSP and a microprocessor, a plurality of microprocessors, one or more microprocessors in conjunction with a DSP core, or any other such configuration.

A general-purpose processor may be part of a general-purpose computer. However, when configured to execute instructions (e.g., software code) for carrying out embodiments of the present disclosure the general-purpose computer should be considered a special-purpose computer. Moreover, when configured according to embodiments of the present disclosure, such a special-purpose computer improves the function of a general-purpose computer because, absent the present disclosure, the general-purpose computer would not be able to carry out the processes of the present disclosure. The processes of the present disclosure, when carried out by the special-purpose computer, are processes that a human would not be able to perform in a reasonable amount of time due to the complexities of the data processing, decision making, communication, interactive nature, or combinations thereof for the present disclosure. The present disclosure also provides meaningful limitations in one or more particular technical environments that go beyond an abstract idea. For example, embodiments of the present disclosure provide improvements in the technical field related to the present disclosure.

The memory 646 may be used to hold computing instructions, data, and other information for performing a wide variety of tasks including administering wagering games of the present disclosure. By way of example, and not limitation, the memory 646 may include Synchronous Random Access Memory (SRAM), Dynamic RAM (DRAM), Read-Only Memory (ROM), Flash memory, and the like.

The display 658 may be a wide variety of displays such as, for example, light emitting diode displays, liquid crystal displays, cathode ray tubes, and the like. In addition, the display 658 may be configured with a touch-screen feature for accepting user input as a user interface element 644.

As nonlimiting examples, the user interface elements 644 may include elements such as displays, keyboards, push-buttons, mice, joysticks, haptic devices, microphones, speakers, cameras, and touchscreens.

As nonlimiting examples, the communication elements 656 may be configured for communicating with other devices or communication networks. As nonlimiting examples, the communication elements 656 may include elements for communicating on wired and wireless communication media, such as, for example, serial ports, parallel ports, Ethernet connections, universal serial bus (USB) connections, IEEE 1394 ("firewire") connections, THUNDERBOLT™ connections, BLUETOOTH® wireless networks, ZigBee wireless networks, 802.11 type wireless networks, cellular telephone/data networks, and other suitable communication interfaces and protocols.

The storage 648 may be used for storing relatively large amounts of nonvolatile information for use in the computing system 640 and may be configured as one or more storage devices. By way of example, and not limitation, these storage devices may include computer-readable media (CRM). This CRM may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

A person of ordinary skill in the art will recognize that the computing system 640 may be configured in many different ways with different types of interconnecting buses between the various elements. Moreover, the various elements may be subdivided physically, functionally, or a combination thereof. As one nonlimiting example, the memory 646 may be divided into cache memory, graphics memory, and main memory. Each of these memories may communicate directly or indirectly with the one or more processors 642 on separate buses, partially-combined buses, or a common bus.

As a specific, nonlimiting example, various methods and features of the present disclosure may be implemented in a mobile, remote, or mobile and remote environment over one or more of Internet, cellular communication (e.g., Broadband), near field communication networks and other communication networks referred to collectively herein as an iGaming environment. The iGaming environment may be accessed through social media environments such as FACEBOOK® and the like. DragonPlay Ltd, acquired by Bally Technologies Inc., provides an example of a platform to provide games to user devices, such as cellular telephones and other devices utilizing ANDROID®, iPHONE® and FACEBOOK® platforms. Where permitted by jurisdiction, the iGaming environment can include pay-to-play (P2P) gaming where a player, from their device, can make value based wagers and receive value based awards. Where P2P is not permitted the features can be expressed as entertainment only gaming where players wager virtual credits having no value or risk no wager whatsoever such as playing a promotion game or feature.

Figure 11:
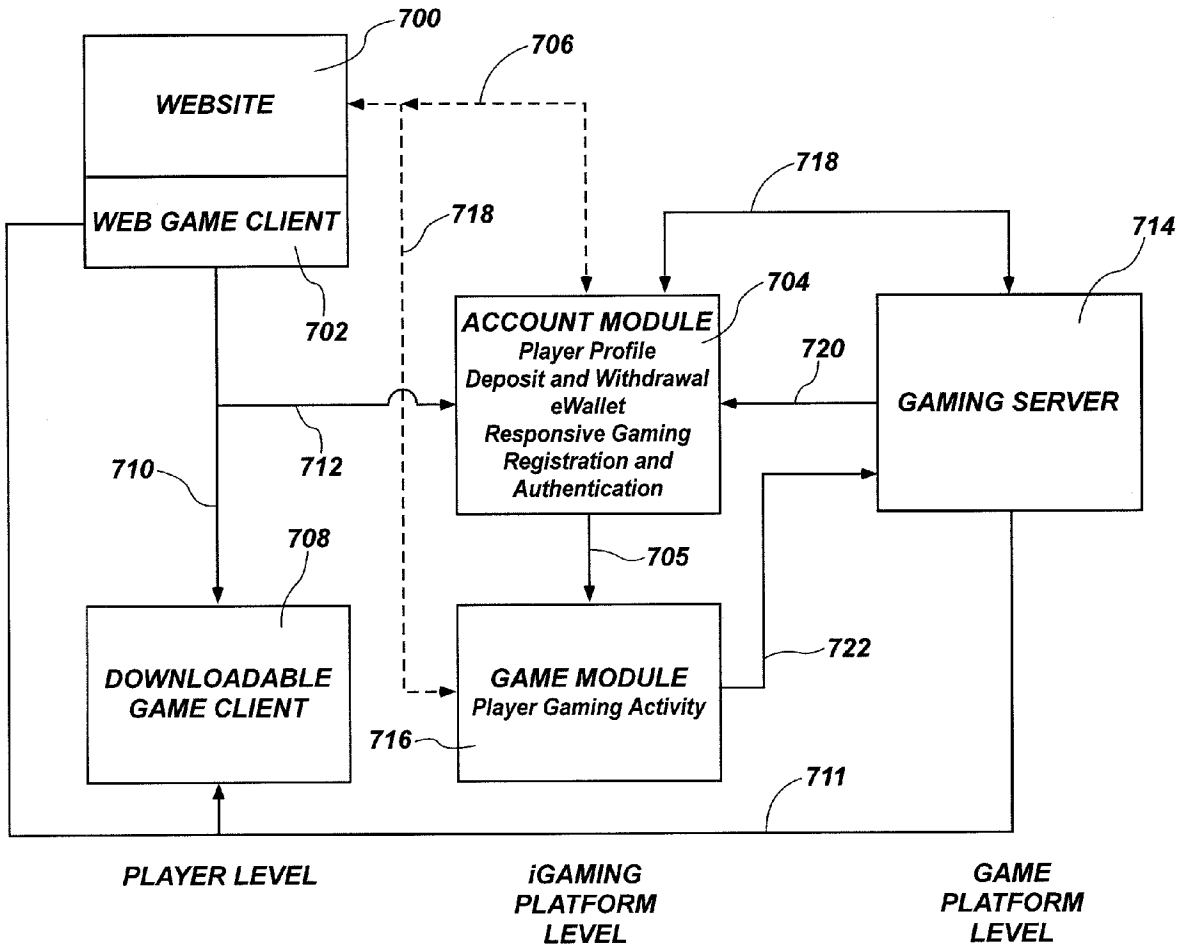
FIG. 11 illustrates an embodiment of data flows between various applications/services for supporting the game, feature or utility of the present invention for mobile/interactive gaming.

FIG. 11 illustrates an illustrative embodiment of information flows in an iGaming environment. At a player level, the player or user accesses a site hosting the activity such as a website 700. The website 700 may functionally provide a web game client 702. The web game client 702 may be, for example, represented by a game client 708 downloadable at information flow 710, which may process applets transmitted from a gaming server 714 at information flow 711 for rendering and processing game play at a player's remote device. Where the game is a P2P game, the gaming server 714 may process value-based wagers (e.g., money wagers) and randomly generate an outcome for rendition at the player's device. In some embodiments, the web game client 702 may access a local memory store to drive the graphic display at the player's device. In other embodiments, all or a portion of the game graphics may be streamed to the player's device with the web game client 702 enabling player interaction and display of game features and outcomes at the player's device.

The website 700 may access a player-centric, iGaming-platform-level account module 704 at information flow 706 for the player to establish and confirm credentials for play and, where permitted, access an account (e.g., an eWallet) for wagering. The account module may include or access data related to the player's profile (e.g., player-centric information desired to be retained and tracked by the host), the player's electronic account, deposit, and withdrawal records, registration and authentication information, such as username and password, name and address information, date of birth, a copy of a government issued identification document, such as a driver's license or passport, and biometric identification criteria, such as fingerprint or facial recognition data, and a responsible gaming module containing information, such as self-imposed or jurisdictionally imposed gaming restraints, such as loss limits, daily limits and duration limits. The account module 704 may also contain and enforce geo-location limits, such as geographic areas where the player may play P2P games, user device IP address confirmation, and the like.

The account module 704 communicates at information flow 705 with a game module 716 to complete log-ins, registrations, and other activities. The game module may also store or access a player's gaming history, such as player tracking and loyalty club account information. The game module 716 may provide static web pages to the player's device from the game module 716 through information flow 718, whereas, as stated above, the live game content may be provided from the gaming server 714 to the web game client through information flow 711.

The gaming server 714 may be configured to provide interaction between the game and the player, such as receiving wager information, game selection, inter-game player selections or choices to play a game to its conclusion, and the random selection of game outcomes and graphics packages, which, alone or in conjunction with the downloadable game client 708/web game client 702 and game module 716, provide for the display of game graphics and player interactive interfaces. At information flow 718, player account and log-in information may be provided to the gaming server 714 from the account module 704 to enable gaming. Information flow 720 provides wager/credit information between the account module 704 and gaming server 714 for the play of the game and may display credits and eWallet availability. Information flow 722 may provide player tracking information for the gaming server 714 for tracking the player's play. The tracking of play may be used for purposes of providing loyalty rewards to a player, determining preferences, and the like.

All or portions of the features of FIG. 11 may be supported by servers and databases located remotely from a player's mobile device and may be hosted or sponsored by regulated gaming entity for P2P gaming or, where P2P is not permitted, for entertainment only play.

In some embodiments, wagering games may be administered in an at least partially player-pooled format, with payouts on pooled wagers being paid from a pot to players and losses on wagers being collected into the pot and eventually distributed to one or more players. Such player-pooled embodiments may include a player-pooled progressive embodiment, in which a pot is eventually distributed when a predetermined progressive-winning hand combination or composition is dealt. Player-pooled embodiments may also include a dividend refund embodiment, in which at least a portion of the pot is eventually distributed in the form of a refund distributed, e.g., pro-rata, to the players who contributed to the pot.

In some player-pooled embodiments, the game administrator may not obtain profits from chance-based events occurring in the wagering games that result in lost wagers. Instead, lost wagers may be redistributed back to the players. To profit from the wagering game, the game administrator may retain a commission, such as, for example, a player entrance fee or a rake taken on wagers, such that the amount obtained by the game administrator in exchange for hosting the wagering game is limited to the commission and is not based on the chance events occurring in the wagering game itself. The game administrator may also charge a rent or flat fee to participate. Specific, illustrative mechanisms for redistributing the lost wagers back to players are described in connection with FIGS. 12 and 13.

Figure 12:
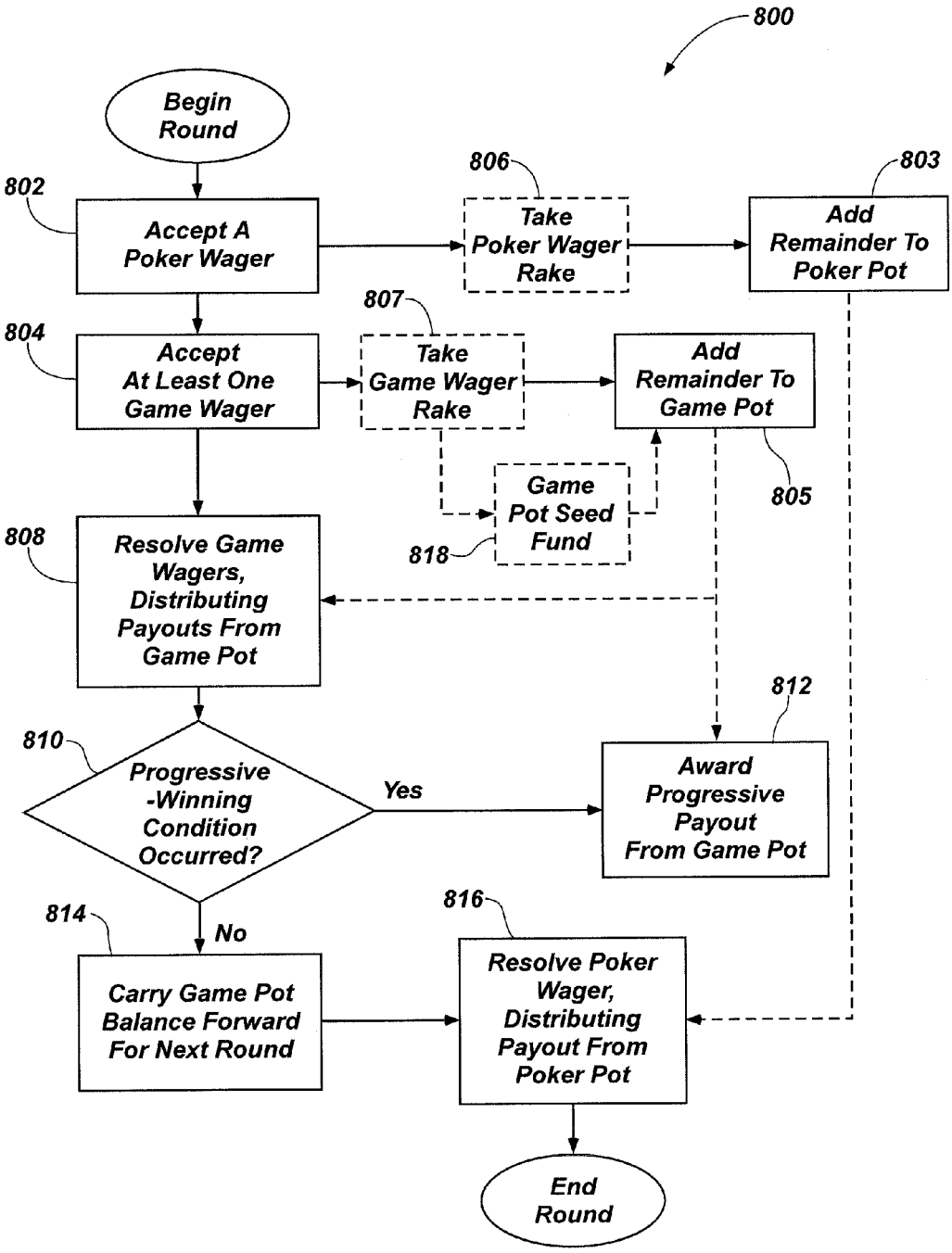
FIG. 12 is a flowchart diagram of a method of administering a wagering game, which may be at least partially player-pooled, according to a player-pooled progressive embodiment.

Referring to FIG. 12, shown is a flowchart diagram of a method 800 of administering a wagering game, which may be at least partially player-pooled, according to a player-pooled progressive embodiment. The method 800 includes accepting a first mandatory wager, referred to herein as a "poker wager," as indicated at 802. At least a portion of the poker wager is added to a poker pot, as indicated at operation 803. The poker wager may be later resolved by comparing player hands and awarding the poker pot, or at least a portion thereof, to the player holding a highest ranking hand according to the rules of the base game in that round of play. For example, in a five-card poker game, four of a kind would outrank three of a kind. As another example, in a game of blackjack, a hand scoring closest to 21 without exceeding 21 when compared to other participating players would be the highest ranking hand.

The poker pot may be a nonprogressive pot; more specifically, all or substantially all of the poker pot may be distributed at the conclusion of each round of the wagering game. In some embodiments, the poker wager may be a mandatory wager to qualify the player for play of the underlying wagering game. In other embodiments, the poker wager may be optional, and the wagering game may be administered to a player without receiving the poker wager and without qualifying the player for a potential payout from the poker pot.

At least one game wager may also be accepted, as indicated at 804. The game wagers may include, for example, base game wagers (e.g., ante wagers, blind wagers, play wagers, raises, and other wagers made on the underlying wagering game), side wagers, or both. More specifically, the game wagers may comprise, for example, the base game wager and the side wager described previously in connection with FIG. 1. At least a portion of each game wager is added to a game pot, as indicated at operation 805, which game pot may be a progressive pot.

In some embodiments, acceptance of the at least one game wager qualifies a player to be eligible to win an award in addition to the payouts available from the underlying game (i.e., the payouts on the base game wager and the side wager described previously in connection with FIG. 1), such as, for example, a progressive payout (e.g., a progressive jackpot awarded to one or more qualifying players). Therefore, in some such embodiments, a progressive wager may be received, in addition to the other game wagers received from the player, such as the base game wager and the side wager described previously in connection with FIG. 1. In other such embodiments, one of the game wagers may be converted to a progressive wager, such as, for example, the base game wager and the side wager described previously in connection with FIG. 1. In some embodiments, the progressive wager may be a mandatory wager to qualify the player for play of the underlying wagering game. In other embodiments, the progressive wager may be optional, and the wagering game may be administered to a player without receiving the progressive wager, in addition to any other game wagers, from the player and without qualifying the player to be eligible to win the progressive payout from the game pot.

In some embodiments, the poker wager and the at least one game wager may be received as indistinct wagers, with a portion thereof being designated for the poker pot (a non-progressive pot) and another portion being designated for the game pot (a progressive pot).

In some embodiments, the game pot may be a pooled or linked pot. For example, the game pot may include one or more game wagers accepted from multiple concurrent wagering games. As another example, the game pot may include pooled progressive wagers from those wagering games currently being played and may include accumulated game wagers from past wagering games. As specific, non-limiting examples, the game pot may include all game wagers accepted from a group of electronic gaming tables or other local wagering game administration devices at a casino, from multiple groups of remote devices connected to network gaming architecture, or both. In other embodiments, the game pot may not be pooled, and awards for the game wager may be limited to the amounts wagered at a respective electronic gaming table, other local wagering game administration device, or group of remote devices.

The game administrator may take a "rake" (e.g., a commission for the house) on at least one wager, such as the poker wager, as indicated at operation 806, the at least one game wager, as indicated at operation 807, or both. In some embodiments, therefore, a rake may be taken on all wagers, or any wager. For example, the house may collect a portion of the poker wager at the time the poker wager is placed. Additionally or alternatively, the house may collect a portion of the game wagers at the time the game wagers are placed.

The rake may be, for example, a fixed percentage of the wagers. More specifically, the percentage of the wagers collected for the rake may be, for example, greater than a theoretical house advantage for the underlying game. As another example, the rake may be less than an average house advantage for play of the wagering game by all players, including average and sub-average players, which may be calculated using a historical house advantage for the wagering game (e.g., a house advantage for the wagering game over the last 5, 10, or 15 years for a given casino or other gaming establishment). As specific, nonlimiting examples, the percentage of the wagers (i.e., either or both of the poker wager and the at least one game wager) collected for the rake may be between 3% and 8%, between 4% and 7%, or between 5% and 6%. In other embodiments, the portion of the wagers collected for the rake may be a variable percentage of the wagers or may be a fixed quantity (e.g., a flat fee) irrespective of the total amount for the wagers, a fixed percentage with a cap, or a time-based fee for increments of time playing the wagering game. Thus, in lieu of, or in addition to, a rake taken on one or more wagers, the house may be compensated in a number of other ways, including, without limitation, a flat fee per round of play, a percentage of wagers made with or without a cap, rental of a player "seat," or otherwise as is known in the gaming art. All such compensation may be generally referred to as a "commission."

All profits for the house may be made from the rake (or rakes or other commission) in some player-banked embodiments. In such embodiments, wagered amounts in excess of the rake are distributed either in the form of, for example, a progressive payout (as in a "player-pooled progressive" embodiment (FIG. 12)), a dividend refund (as in a "dividend refund" embodiment (FIG. 13)), or some combination thereof. Thus, the profits for the house may be limited. Such limiting of profits for the house and redistribution of wagers back to one or more players may increase the attractiveness of the wagering game to both inexperienced and highly skilled players. Because the amount earned by the house is known, highly skilled players may perceive that their skill will enable them to increase winnings, and inexperienced players may be enticed by the possibility of winning or otherwise earning a portion or all of one or more of the pots. In other embodiments, the house may make profits on the rake and on losses from one or more of the wagers (e.g., the base game wager and the side wager described previously in connection with FIG. 1), including losses resulting from optimal and suboptimal play.

The rake may be maintained in a rake account, and profits for the house may be deducted from the rake account. When and if taken from the poker wagers, the poker wager rake (operation 806) may be taken by, for example, electronically transferring funds from the poker wagers to a poker pot rake account (e.g., as instructed by a game service 616 (see FIG. 8) using casino account servers 632 (see FIG. 8)). Likewise, when and if taken from the game wagers, the game wager rake (operation 807) may be taken by, e.g., electronically transferring funds from the game pot wagers to a game pot rake account (e.g., as instructed by the game service 616 (see FIG. 8) using casino account servers 632 (see FIG. 8)).

In some embodiments, the poker wager may be accepted (operation 802) at the beginning of a round of administration of the wagering game. One or more of the game wagers may be accepted (operation 804) at the beginning of the round as well, e.g., the base game wager and the side wager described previously in connection with FIG. 1. In some embodiments, additional game wagers may be accepted (operation 804), possibly raked (operation 807), and added to the game pot (operation 805) in the intermediate segments of the round of play.

The underlying wagering game may be played as described above, including resolving the game wagers received during the round of play, as indicated at operation 808. For example, the underlying wagering game may be played at least substantially as described previously in connection with FIGS. 1 through 3. Payouts to be distributed, as a result of resolving the game wagers, (e.g., the payouts on the base game wager and the side wager described previously in connection with FIG. 1), are paid from the game pot.

It is contemplated that only a portion of the game pot may be distributed, at operation 806, in the form of payouts on the underlying game. At least in embodiments in which the game pot is configured as a progressive pot (e.g., if one of the game wagers is a progressive wager or one game outcome of a low frequency pays the amount of the pot), all or substantially all of the remaining portion of the game pot may be designated for a potential progressive payout. For example, administering the player-pooled progressive embodiment of the player-pooled wagering game may include determining whether a progressive-winning condition has occurred, as indicated at operation 810. A progressive-winning condition may be predefined as a predetermined winning hand combination being dealt, which may result in an award of, for example, a portion of the game pot, or a premium winning hand composition being dealt, which may result in an award of, for example, an entire amount of the game pot. If such a progressive-winning condition has occurred during the round of game administration, a progressive payout may be awarded to the winning-hand-holding player, with the progressive payout being paid from the game pot, as indicated at operation 812. As some specific, nonlimiting examples, a game may pay a progressive payout for achieving a blackjack in a game of blackjack or a variant of blackjack, achieving a score of 20 in a game of blackjack or a variant of blackjack, achieving a four of a kind or higher in a game of poker or a variant of poker. If no progressive-winning condition has occurred, a progressive payout may not be paid from the game pot, but, rather, the game pot balance may be carried forward for the next round of play and so on, as indicated at operation 814, until a progressive-winning condition occurs during a subsequent round. Thus, the game pot may not be awarded at the end of each round of play, but may grow during each successive round in which no player is dealt a predetermined winning hand combination or a premium winning hand composition. However, if the underlying game payouts distributed at operation 808, or if a progressive payout is awarded at operation 812, without draining the game pot, the game pot may decrement until the game pot contributions, at operation 805, rebuild the game pot.

A predetermined winning hand combination may be, for example, a four-of-a-kind, a full house, a flush, a straight, a three-of-a-kind, two pair, or one pair. The hands qualifying as new winning hand combinations may be predetermined at the beginning of each round of play in some embodiments. In other embodiments, new winning hand combinations may be predetermined at the beginning of play and may remain fixed until it is determined that at least one player hand achieves a predetermined winning hand combination, at which time new winning hand combinations may be predetermined. In still other embodiments, the hand combinations qualifying as winning hand combinations may be predetermined at the outset of the wagering game and remain fixed for the duration of the wagering game. The hands qualifying as winning hand combinations may be predetermined at random from a list of possible winning hand combinations, from among a schedule with a fixed rotation of possible winning hand combinations, or using a fixed table of winning hand combinations.

A premium winning hand composition may be, for example, a four-of-a-kind, a straight flush, or a royal flush. The hand compositions qualifying as premium winning hand compositions may remain fixed throughout the duration of the wagering game or may change during the wagering game. For example, after it has been determined that a player hand has achieved a premium winning hand composition, the hand compositions qualifying as premium winning hand compositions may be made more restrictive or less restrictive. As a specific, nonlimiting example, after identification of a player hand achieving a straight flush, the hand compositions qualifying as premium winning hand compositions may be restricted to royal flushes or may be expanded to include four-of-a-kind. The hands qualifying as premium winning hand compositions may be predetermined at random from a list of possible premium winning hand compositions, following a schedule with a fixed rotation of possible premium winning hand compositions, or according to a fixed table of premium winning hand compositions.

In embodiments in which the game pot is a progressive pot, the amount awarded from the game pot for achieving a premium winning hand composition may be a progressive payout at least as great as a maximum progressive payout for achieving a predetermined winning hand composition. For example, the entire game pot may be awarded when a player or multiple players are dealt a premium winning hand composition, and only a portion of the game pot may be awarded when a player or multiple players are dealt a predetermined winning hand combination.

Awarding the game pot or a portion of the game pot may involve crediting a player account with funds from the game pot or may comprise distributing physical money or physical representations of money from the game pot to the player.

Before, between, or after resolving the game wagers (operation 808), determining whether a progressive-winning condition occurred (operation 810), awarding a progressive payout (operation 812), or any combination thereof, the poker wager may be resolved, and the poker pot may be awarded to at least one player, as indicated at operation 816. Each successive round of receiving wagers, dealing cards, and resolving wagers may constitute a round of play, and the poker pot may be awarded to at least one player before the end of each round of play. The player to whom the poker pot is awarded may hold a highest ranking hand of all hands dealt in a round on a table using conventional poker rankings, or a ranking system specific to the disclosed games when compared to the hands of other players at the virtual "table."

Awarding the poker pot or the portion of the poker pot may involve crediting a player account of each winning player or may comprise distributing physical money or physical representations of money to each winning player.

In some embodiments, an entire amount of the poker pot may be awarded to at least one player before the end of each round of play. In such embodiments, the poker pot may be a nonprogressive pot. Awarding the entire amount of a poker pot to at least one player at the end of each round of play redistributes lost poker wagers attributable to suboptimal play to other players, rather than to the house.

In some embodiments involving a no-house-advantage poker pot awarded at the end of each round and a progressive game pot that receives all other game wagers, all players participating in the wagering game from whom the at least one game wager has been received may be eligible to win the game pot or a portion of the game pot. Players who are ineligible to win the poker pot, and players from whom fold indications have been received but from whom one or more other active wagers in play have been received, may be eligible to win the game pot or a portion of the game pot.

In some embodiments, the game pot may be seeded with money from the game pot rake account or a reserve account (as indicated at operation 818) at the beginning of play, after the game pot or a portion of the game pot has been awarded, or both. In some embodiments, a minimum account balance sufficient to cover expected losses is retained when distributing a progressive payout (operation 812) such that no seed money is required in the game pot. For example, the game pot may be seeded from the rake account of the house (operation 818), and the house may maintain an amount of funds in the rake account sufficient to significantly reduce (e.g., to essentially eliminate) the likelihood that any payouts made from the rake account and any seeding amounts withdrawn from the rake account exhaust or overdraw the rake account. In some embodiments, a casino reserve account may be provided to fill the rake account in the event of an overdraw. Such seeding may incentivize players to participate in the wagering game, and specifically to place a game wager (e.g., a progressive wager) to be eligible for the progressive payout from the game pot. In addition, such seeding may reduce the likelihood that the amount of funds in the game pot may be insufficient to cover all the payouts to players. For example, where a player hand achieves a premium winning hand composition in one round of play, a player hand achieves a predetermined winning hand combination in the immediately following round of play, and a fixed-odds payout is to be awarded to the player holding the predetermined winning hand combination, the amount seeded to the game pot between those rounds of play may be at least as great as the maximum fixed-odds payout awardable for any predetermined winning hand combination. The game pot may be seeded each time the game pot is awarded in its entirety or each time the amount in the game pot is lower than the maximum fixed-odds payout.

Figure 13:
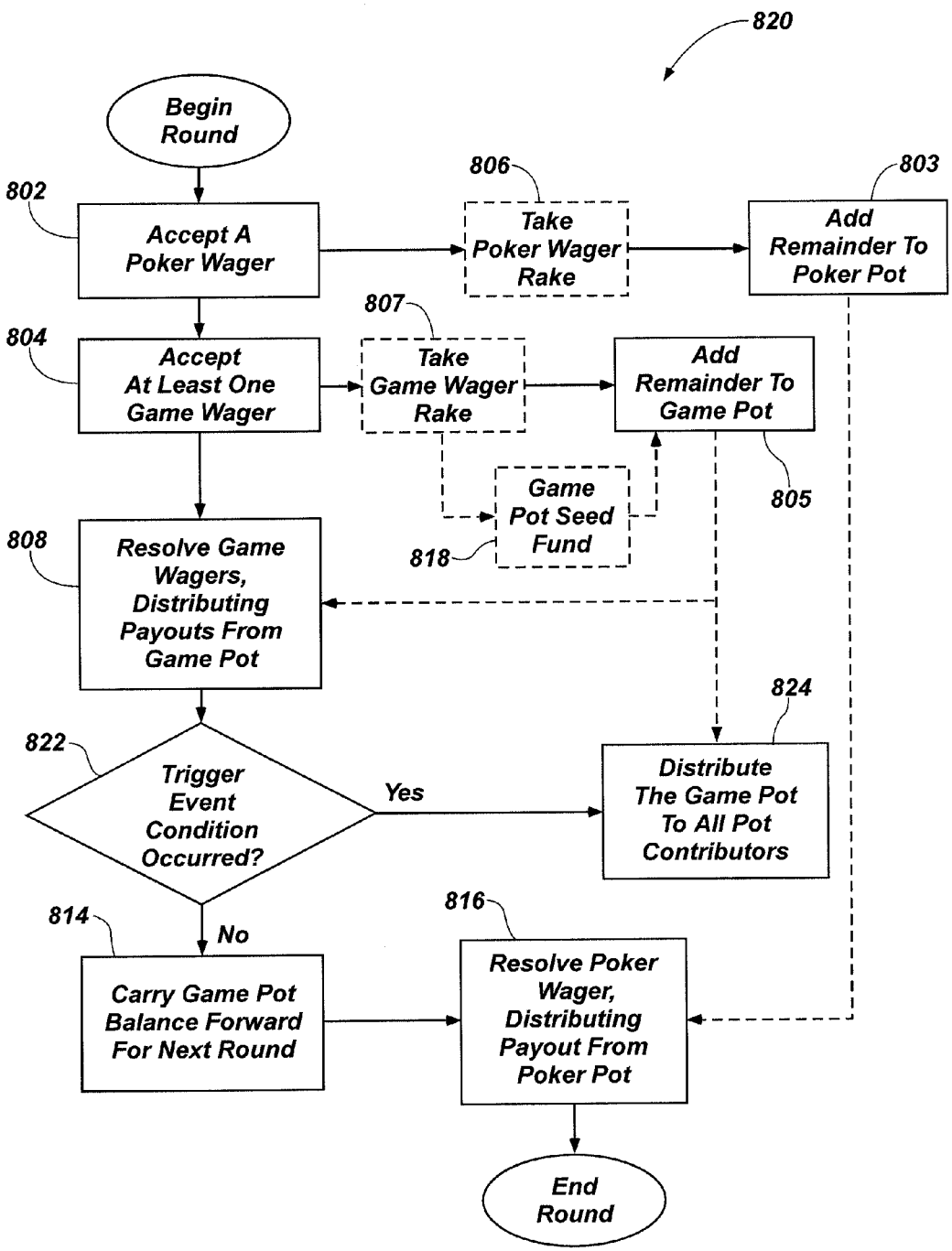
FIG. 13 is a flowchart diagram of a method of administering a wagering game, which may also be at least partially player-pooled, according to a dividend refund embodiment.

FIG. 13 is a flowchart diagram of a method 820 of administering a wagering game, which may be at least partially player-pooled, according to a dividend refund embodiment. The method 820 is largely the same as the method 800 of the player-pooled progressive (FIG. 12), with the exception that, rather than determining whether a progressive-winning condition has occurred (operation 810 (FIG. 12)), the method 820 includes determining whether a trigger event condition has occurred, as indicated at operation 822, and, if so, distributing the game pot to one or more past or present players of the wagering game, as indicated at operation 824 (rather than distributing the game pot as a progressive payout as at operation 812 (FIG. 12)). In such embodiment, the game pot may accumulate between rounds of play, and, to periodically reduce the balance, a dividend (e.g., a share of the game pot awarded to each participating player) may be awarded to players from the game pot. Thus, what would otherwise be the profits from lost wagers, less amounts raked by the house, are redistributed back to the players, rather than collected by the house as revenue. Thus, the distribution is not a payout on the underlying game, but a refund.

The game pot may be distributed among a plurality of players upon the occurrence of a predetermined event (referred to herein as a "trigger event"), as indicated at operation 822. The predetermined, trigger event may not be based, for example, on player skill or chance events occurring in the underlying wagering game. The predetermined trigger event may comprise, for example, determination that at least one player participated for a predetermined number of hands; completed a predetermined number of rounds of play at a given table, electronic gaming machine, or remote gaming device; reached a predetermined time limit since play commenced; or reached a predetermined amount within the game pot. The predetermined trigger event or condition may be time-based, pot-based (or pool-based), game-based, amount-based, or other-based. Further details on pot distributions based on predetermined trigger events and conditions are disclosed in the U.S. patent application Ser. No. 13/871,824, filed Apr. 26, 2013, titled "DISTRIBUTING SUPPLEMENTAL POT IN WAGERING GAMES BASED ON PREDETERMINED EVENT," the disclosure of which is incorporated herein in its entirety by this reference.

The dividend distributions may be divided at least among players currently participating in the wagering game. In some embodiments, the dividend distributions may also be paid to players who previously contributed to the game pot but who have since ceased participating in the wagering game. In some embodiments, the dividend distributions may not be paid to players from whom contributions to the game pot have not been received since the last dividend distribution was paid. The percentage of the game pot refunded to each player as a dividend distribution may be, for example, approximately equal to the percentage of hands won by each player, the percentage of first pot winnings won by each player based on game play, the percentage of total wager amounts received from each player, the proportional number of wagers received from each player, the proportional length of time spent playing the wagering game by each player, or an equal percentage for each player eligible to receive a dividend distribution from the game pot.

The dividend refund may be distributed in the form of a credit made to the receiving players' accounts. In some embodiments, the refund may be paid without concurrently alerting the player, though the refund may be noticeable when and if the player next checks his or her balance in his or her player account.

In some embodiments, wagering games may be administered without players risking money in connection with the wagers (i.e., "play-for-fun" games). Access to play-for-fun wagering games may be granted on a time period basis in some embodiments. For example, upon initially joining the wagering game, each player may automatically be given nonmonetary wagering elements, such as, for example, chips, points, or simulated currency, that are of no redeemable value. After joining, the player may be permitted to place bets using the wagering elements and a timer may track how long the player has been participating in the wagering game. If the player exhausts his or her supply of the wagering elements before a predetermined period of time has expired, the player may be permitted to simply wait until the period of time passes to rejoin the game, at which time access to another quantity of the wagering elements may be granted to the player to permit the player to resume participation in the wagering game.

In some embodiments, a hierarchy of players may determine the quantity of wagering elements given to a player for each predetermined period of time. For example, players who have been participating in the wagering game for a longer time, who have played closest to optimal strategy for the game, who have won the largest percentage of wagers, who have wagered the most in a play-for-pay environment, or who have won the largest quantities of wagering elements from their wagers may be given more wagering elements for each allotment of time than players who have newly joined, who have played according to poor strategy, who have lost more frequently, or who have lost larger quantities of wagering elements. In some embodiments, the hierarchy of players may determine the duration of each allotment of time. For example, players who have been participating in the wagering game for a longer time, who have played closest to optimal strategy for the game, who have won the largest percentage of wagers, or who have won the largest quantities of wagering elements from their wagers may be given shorter allotments of times to wait for an award of more wagering elements than players who have newly joined, who have played according to poor strategy, who have lost more frequently, or who have lost larger quantities of wagering elements. In some embodiments, players who have not run out of wagering elements after the period of time has expired may have the balance of their wagering elements reset for a subsequent allotment of time. In other embodiments, players who have not run out of wagering elements may be allowed to retain their remaining wagering elements for subsequent allotments of time, and may be given additional wagering elements corresponding to the new allotment of time to further increase the balance of wagering elements at their disposal. Players may be assigned to different categories of players, which determine the number of wagering elements awarded. In a given period of time, higher level players, or players who have invested more time playing the game may be allotted more wagering elements per unit of time than a player assigned to a lower level group.

Therefore, in some embodiments, the wagering game may be administered by receiving wagers (e.g., the base game wager and the side wager described previously in connection with FIG. 1) of no real-world monetary value, and payouts (e.g., the payouts on the base game wager and the side wager described previously in connection with FIG. 1) may be paid without transferring real-world monetary value to the players. Such embodiments, referred to herein as "free play-for-fun" embodiments are nonetheless contemplated as modes of carrying out the methods described herein.

In some embodiments, referred to herein as "social play-for-fun" embodiments, a player may be permitted to redeem an access token of no redeemable face value, such as, for example, points associated with a player account (e.g., social media account credits, online points associated with a transacting account, etc.), to compress the period of time and receive more wagering elements. The access tokens may be sold or may be given without directly exchanging money for the access tokens. For example, access tokens may be allocated to players who participate in member events (e.g., complete surveys, receive training on how to play the wagering game, share information about the wagering game with others), spend time participating in the wagering game or in a player account forum (e.g., logged in to a social media account), or view advertising. Thus, an entity administering social play-for-fun wagering games may not receive money from losing player wagers or may not take a rake on wagers, but may receive compensation through advertising revenue or through the purchase of access tokens redeemable for time compressions to continue play of the wagering game or simply to increase the quantity of wagering elements available to a player.

After receipt of an indication that a player has stopped participating in a play-for-fun wagering game (e.g., a free play-for-fun embodiment, a social play-for-fun embodiment), any remaining quantities of the wagering elements may be relinquished by the player and retained by the administrator, in some embodiments. For example, receipt of an indication that the player has logged out of a play-for-fun wagering game administered over the Internet may cause any remaining wagering elements associated with a respective player to be lost. Thus, when the player rejoins the play-for-fun wagering game, the quantity of wagering elements given to the player for an allotment of time may not bear any relationship to the quantity of wagering elements held by the player when he or she quit playing a previous session of the wagering game. In other embodiments, upon receipt of an indication that a player has stopped playing, the quantity of wagering elements held by the player at that time may be retained and made available to the player, along with any additional quantities of wagering elements granted for new allotments of time, upon receipt of an indication that the player has rejoined the wagering game.

Cards used in games of the present invention may be standard playing cards, each deck having four suits (clubs, hearts, diamonds and spades) and having rankings ace, king, queen, jack, 10, 9, 8, 7, 6, 5, 4, 3, 2). Cards used in games of the present invention may be randomized in a card-handling device that utilizes a random number generator to determine the desired card order. Typically 6-8 decks are intermixed. One such device is marketed under the name MD3® by Bally Gaming, Inc. of Las Vegas, Nev. Aspects of this device are described in U.S. Pat. No. 8,579,289 and the shuffling mechanism is fully described in U.S. Pat. No. 7,677,565, the disclosures of which are incorporated by reference in their entirety. Typically 6 or 8 standard decks of 52 cards each are intermixed and formed into a set, which after shuffling is transferred into a card-handling device such as a mechanized shoe capable of reading card rank and suit, such as the shoe disclosed in U.S. Pat. No. 8,511,684, the content of which is incorporated by reference in its entirety.

Cards may also be dispensed from a shuffler that provides a continuous supply of cards dealt individually into a card game, such as cards dispensed from a ONE2SIX® shuffler marketed by Bally Gaming, Inc., and disclosed in U.S. Pat. No. 6,659,460 (RE 42,944), the content of which is incorporated by reference in its entirety.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may result in embodiments within the scope of this disclosure, such as those specifically claimed, including legal equivalents. In addition, features from one disclosed embodiment may be combined with features of another disclosed embodiment while still being within the scope of this disclosure, as contemplated by the inventor.

What is claimed is:

1. A method of administering a wagering game, comprising:

accepting a base game wager from a player to participate in a base game by receiving at least one physical, monetarily valuable wagering element in a player area on a layout of a gaming table, the base game involving placing one or more physical lammers on the layout of the gaming table in response to an occurrence of one or more chance events, acceptance of one or more player instructions affecting game play of the base game, or the occurrence of the one or more chance events and the acceptance of the one or more player instructions affecting the game play of the base game in response to the occurrence of the one or more chance events;

accepting an optional side wager from the player before any qualifying lammers can be placed on the layout by receiving at least another physical, monetarily valuable wagering element in the player area;

conducting a single round of play of the base game;

resolving the side wager by determining whether a number of qualifying lammers has been placed on the layout of the gaming table; and paying a payout on the side wager to the player in response to a presence of at least one qualifying lammer on the layout of the gaming table at a conclusion of the single round of play of the base game by transferring at least one physical, monetarily valuable wagering element to the player.

2. The method of claim 1, wherein the base game involves placing an additional lammer on the layout of the gaming table in response to each occurrence of the one or more chance events, each acceptance of the one or more player instructions affecting the game play of the base game, or each occurrence of the one or more chance events and each corresponding acceptance of the one or more player instructions affecting the game play of the base game in response to each occurrence of the one or more chance events.

3. The method of claim 2, wherein paying the payout on the side wager comprises paying the payout in an increased amount as the number of qualifying lammers on the layout of the gaming table increases.

4. The method of claim 3, wherein paying the payout in the increased amount as the number of qualifying lammers on the layout of the gaming table increases comprises paying a fixed odds payout utilizing increasing fixed payout multipliers as the number of qualifying lammers on the layout of the gaming table increases.

5. The method of claim 2, wherein the base game involves placing each lammer in the player area on the layout of the gaming table in response to each occurrence of the one or more chance events, each acceptance of the one or more player instructions affecting the game play of the base game, or each occurrence of the one or more chance events and each corresponding acceptance of the one or more player instructions affecting the game play of the base game in response to each occurrence of the one or more chance events.

6. The method of claim 1, wherein accepting the base game wager comprises accepting an ante wager on a game of blackjack or a variant of blackjack.

7. The method of claim 6, further comprising placing a lammer in the player area on the layout of the gaming table in response to:

dealing to the player two cards having equal value according to rules of blackjack or the variant of blackjack from a deck of physical cards comprising at least a 52-card set of standard playing cards; and accepting from the player an instruction to split.

8. The method of claim 7, further comprising accepting from the player the instruction to split without requiring the player to wager additional monetary value in connection with the split.

9. The method of claim 6, further comprising:

dealing to the player two cards from a deck of physical cards comprising at least a 52-card set of standard playing cards;

placing a lammer in the player area on the layout of the gaming table in response to accepting from the player an instruction to double; and dealing to the player only one additional card from the deck.

10. The method of claim 9, further comprising accepting from the player the instruction to double without requiring the player to wager additional monetary value in connection with the double.

11. A method of administering a wagering game, comprising:

accepting a base game wager from a player to participate in a base game by receiving at least one physical, monetarily valuable wagering element in a player area on a layout of a gaming table, the base game involving placing one or more physical lammers on the layout of the gaming table in response to acceptance of one or more player instructions affecting game play of the base game or an occurrence of one or more chance events and the acceptance of the one or more player instructions affecting the game play of the base game in response to the occurrence of the one or more chance events;

accepting a mandatory side wager from the player before any qualifying lammers can be placed on the layout by receiving at least another physical, monetarily valuable wagering element in the player area;

conducting a single round of play of the base game;

resolving the side wager by determining whether a number of qualifying lammers has been placed on the layout of the gaming table; and paying a payout on the side wager to the player in response to a presence of at least one qualifying lammer on the layout of the gaming table at a conclusion of the single round of play of the base game by transferring at least one physical, monetarily valuable wagering element to the player.

12. The method of claim 11, wherein the base game involves placing each lammer in the player area on the layout of the gaming table in response to each occurrence of the one or more chance events, each acceptance of the one or more player instructions affecting the game play of the base game, or each occurrence of the one or more chance events and each corresponding acceptance of the one or more player instructions affecting the game play of the base game in response to each occurrence of the one or more chance events.

13. The method of claim 12, wherein paying the payout on the side wager comprises paying the payout in an increased amount as the number of qualifying lammers on the layout of the gaming table increases.

14. The method of claim 13, wherein paying the payout in the increased amount as the number of qualifying lammers on the layout of the gaming table increases comprises paying a fixed odds payout utilizing increasing fixed payout multipliers as the number of qualifying lammers on the layout of the gaming table increases.

15. The method of claim 11, wherein accepting the base game wager comprises accepting an ante wager on a game of blackjack or a variant of blackjack.

16. The method of claim 15, further comprising placing a lammer in the player area on the layout of the gaming table in response to:

dealing to the player two cards having equal value according to rules of blackjack or the variant of blackjack from a deck of physical cards comprising at least a 52-card set of standard playing cards; and accepting from the player an instruction to split.

17. The method of claim 16, further comprising accepting from the player the instruction to split without requiring the player to wager additional monetary value in connection with the split.

18. The method of claim 15, further comprising:

dealing to the player two cards from a deck of physical cards comprising at least a 52-card set of standard playing cards;

placing a lammer in the player area on the layout of the gaming table in response to accepting from the player an instruction to double; and dealing to the player only one additional card from the deck.

19. The method of claim 18, further comprising accepting from the player the instruction to double without requiring the player to wager additional monetary value in connection with the double.

20. A method of administering a wagering game over a network utilizing a server comprising a processor, the method comprising:

receiving at a server comprising a processor an electronic signal indicating that allocation of funds to a base game wager was authorized by a player to participate in a base game, the base game involving sending from the server an electronic signal instructing that one or more electronic images of lammers are to be displayed on a client device in response to an occurrence of one or more chance events, acceptance of one or more player instructions affecting game play of the base game, or the occurrence of the one or more chance events and the acceptance of the one or more player instructions affecting the game play of the base game in response to the occurrence of the one or more chance events;

receiving at the server an electronic signal indicating that allocation of funds to a side wager was authorized by the player before any electronic images of qualifying lammers can be displayed;

sending from the server, receiving at the server, or sending from the server and receiving at the server an electronic signal or electronic signals to conduct a single round of play of the base game;

resolving the side wager by determining at the server whether any electronic signals instructing that a number of electronic images of qualifying lammers were to be displayed have been sent; and generating at the server an electronic signal indicating that payment of a payout on the side wager to the player is authorized in response to the sending of at least one electronic signal instructing that one or more electronic images of qualifying lammers were to be displayed at a conclusion of the single round of play of the base game.

* * * * *